US006702423B2

(12) United States Patent
Okamura et al.

(10) Patent No.: US 6,702,423 B2
(45) Date of Patent: Mar. 9, 2004

(54) CLEANING DEVICE FOR INKJET PRINTING HEAD, CLEANING METHOD FOR INKJET PRINTING HEAD, INKJET RECORDING APPARATUS, AND WIPER

(75) Inventors: Yoshitaka Okamura, Fukushima (JP); Takeshi Yazawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/066,350

(22) Filed: Jan. 30, 2002

(65) Prior Publication Data

US 2002/0122092 A1 Sep. 5, 2002

Related U.S. Application Data

(63) Continuation-in-part of application No. 09/318,604, filed on May 26, 1999, now abandoned, and a continuation-in-part of application No. 09/391,516, filed on Sep. 8, 1999, now abandoned.

(30) Foreign Application Priority Data

| | | |
|---|---|---|
| May 27, 1998 | (JP) | 10-146370 |
| Sep. 8, 1998 | (JP) | 10-254409 |
| Oct. 30, 1998 | (JP) | 10-311453 |
| Aug. 30, 1999 | (JP) | 10-243998 |

(51) Int. Cl.[7] ..... B41J 2/165

(52) U.S. Cl. ..... 347/33; 347/29

(58) Field of Search ..... 347/33, 29, 30, 347/31, 32, 40, 41, 43; 15/250.42, 250.001, 256.5

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,558,333 | A | 12/1985 | Sugitani et al. | 347/65 |
| 4,732,129 | A | 3/1988 | Takigawa et al. | 123/478 |

(List continued on next page.)

FOREIGN PATENT DOCUMENTS

| | | |
|---|---|---|
| EP | 0 068 858 | 1/1983 |
| EP | 0 257 178 | 3/1988 |
| EP | 0 295 187 | 12/1988 |
| EP | 0 306 618 | 3/1989 |
| EP | 0 395 004 | 10/1990 |
| EP | 0 446 885 | 9/1991 |
| EP | 0 597 677 | 5/1994 |
| EP | 0 676 290 | 10/1995 |
| JP | 53-106802 | 9/1978 |
| JP | 54-56847 | 5/1979 |
| JP | 59-123670 | 7/1984 |
| JP | 59-138461 | 8/1984 |
| JP | 60-71260 | 4/1985 |
| JP | 62-103147 | 5/1987 |
| JP | 6-115065 | 4/1994 |
| JP | 7-171967 | 7/1995 |
| JP | 7-285226 | 10/1995 |

OTHER PUBLICATIONS

J. Mort, "The anatomy of xerography: its invention and evolution", McFarland & Company, Inc., 1989 (p. 127).

U.S. application Ser. No. 09/382,602, filed Aug. 25, 1999, patented Mar. 21, 2002, U.S. Pat. No. 6,390,592.

*Primary Examiner*—Shih-Wen Hsieh
(74) *Attorney, Agent, or Firm*—Fitzpatrick, Cella, Harper & Scinto

(57) ABSTRACT

The present invention provides a cleaning device for an inkjet printing head and a method for cleaning such a head; a wiper to be used for cleaning the inkjet printing head; and an inkjet printing apparatus having such a wiper for preventing the deposition of ink on the side of a printing head. Slits facing to the side of the printing head are formed on a wiper made of a sheet of rubber, which moves relatively with the printing head.

16 Claims, 42 Drawing Sheets

U.S. PATENT DOCUMENTS

| | | | | | |
|---|---|---|---|---|---|
| 4,740,796 | A | | 4/1988 | Endo et al. | 347/56 |
| 4,940,998 | A | * | 7/1990 | Asakawa | 347/37 |
| 5,095,339 | A | | 3/1992 | Terashima | 355/251 |
| 5,133,283 | A | | 7/1992 | Masuda | 118/657 |
| 5,411,343 | A | | 5/1995 | Childers | 400/692 R |
| 5,539,435 | A | | 7/1996 | Uchida et al. | 347/33 |
| 5,548,310 | A | | 8/1996 | Binnert et al. | 347/33 |
| 5,555,461 | A | | 9/1996 | Ackerman | 347/33 |
| 5,610,641 | A | | 3/1997 | Ikado | 347/33 |
| 5,682,186 | A | * | 10/1997 | Bohorquez et al. | 347/29 |
| 5,742,304 | A | * | 4/1998 | Richtsmeier et al. | 347/40 |
| 5,896,144 | A | | 4/1999 | Kishimoto et al. | 347/30 |
| 5,898,445 | A | | 4/1999 | Becker et al. | 347/33 |
| 5,914,735 | A | | 6/1999 | Yamamoto et al. | 347/33 |
| 5,991,055 | A | | 11/1999 | Haselby et al. | 358/509 |
| 6,033,052 | A | * | 3/2000 | Muraki | 347/33 |
| 6,091,514 | A | | 7/2000 | Hasegawa et al. | 358/296 |
| 6,135,585 | A | | 10/2000 | Johnson et al. | 347/32 |
| 6,390,592 | B2 | | 5/2002 | Okamura | 347/29 |

* cited by examiner

CLEANING DEVICE FOR INKJET PRINTING HEAD, CLEANING METHOD FOR INKJET PRINTING HEAD, INKJET RECORDING APPARATUS, AND WIPER

This application is a continuation-in-part of U.S. application Ser. No. 09/318,604 filed May 26, 1999, now abandoned and of U.S. application Ser. No. 09/391,516 filed Sep. 8, 1999 now abandoned. Accordingly, this application claims priority benefit under 35 U.S.C. §120 to U.S. application Ser. No. 09/318,604 and U.S. application Ser. No. 09/391,516, and also claims priority benefit under 35 U.S.C. §119 to Japanese Patent Application No. 10-146370 filed May 27, 1998, Japanese Patent Application No. 10-311453 filed Oct. 30, 1998, Japanese Patent Application No. 10-254409 filed Sep. 8, 1998, and Japanese Patent Application No. 11-243998, filed Aug. 30, 1999, on which U.S. application Ser. No. 09/318,604 and U.S. application Ser. No. 09/391,516 are collectively based, and the contents of each of the aforementioned U.S. applications and Japanese Applications are incorporated hereinto by reference.

BACKGROUND OF THE INVENTION

1. Field of the Invention

The present invention relates to a cleaning device for an inkjet printing head and a method for cleaning such a head. The present invention also relates to a wiper to be used for cleaning the inkjet recording head, and an inkjet recording apparatus having such a wiper.

2. Description of the Related Art

Printing apparatuses have their respective functions of printing, copying, and facsimile machines, or used as output devices of complex electronic devices (e.g., computers and word processors) and workstations. Each of such printing apparatuses is configured to print an image on an object to be printed (hereinafter, referred as a printing medium) such as a sheet of paper or a plastic sheet in accordance with image information. In addition, the printing apparatus may be classified into one of several types, i.e., inkjet type, wire-dot type, thermal type, laser-beam type, and the like by its printing procedure.

For a serial-type printing apparatus, a printing means performs a main-scanning movement in the direction (i.e., a main-scanning direction) that intersects the direction (i.e., a sub-scanning direction) of transferring a printing medium. The serial-type printing apparatus prints information throughout the printing medium by repeating the following procedure. First, the printing medium is arranged in a predetermined printing position, and subsequently one line of image is printed on the printing medium by the printing means mounted on a carriage that moves along the printing medium in the main-scanning direction. After that, the printing medium shifts its position at a predetermined pitch in the sub-scanning direction (i.e., a pitch transfer) and then a subsequent line of image is printed on the printing medium being stopped again.

For a line-type printing apparatus, on the other hand, a printing means does not perform a main-scanning movement and an image can be printed by a sub-scanning movement of printing medium in its transfer direction. The line-type printing apparatus prints information throughout the printing medium by repeating the following procedure. First, the printing medium is arranged in a predetermined printing position. Then, the printing means placed in a predetermined position prints one line of image on the printing medium at a time. Subsequently, the printing medium shifts its position at a predetermined pitch in the sub-scanning direction (i.e., a pitch transfer), followed by printing a subsequent line of image on the printing medium at a time.

Among the printing apparatuses, the inkjet type printing apparatus (also simply referred as an inkjet printing apparatus) prints information on a printing medium by ejecting ink thereon from a printing means (i.e., a printing head). Such an inkjet printing apparatus can be configured so as to easily make the printing means as compact as possible and print an image with extraordinary definition at high speed on a piece of ordinary paper without a specific treatment thereon. In addition, the inkjet printing apparatus has the advantages of: its excellent cost/performance ratio, an operation mode with a low noise level (i.e., a non-impact operation mode), and a multi-color print using multiple colors with ease. A line-type inkjet printing apparatus, in particular, uses a line-type-printing head where a plurality of orifices is arranged in the width direction of printing medium and allows a high-speed printing more than ever.

Particularly, an inkjet printing head that ejects ink using thermal energies can be easily made as one having a high-density liquid path arrangement (a high-density orifice arrangement) by means of semiconductor fabrication process including etching, sputtering, and deposition to form electrothermal conversion elements, electrodes, liquid-path walls, and a top plate on a substrate, resulting in compact more than ever.

There is a wide variety of demands on the material of printing medium. In recent years, the use of thin paper and converted paper (e.g., paper punched with holes or perforated for filing, and paper with some specified shape) has come to be demanded by a person skilled in the art in addition to the use of ordinary printing media such as ordinary paper and resin thin plate (e.g., OHP sheet).

For the inkjet printing apparatus described above, an ink-supplying path from an ink tank to the inkjet printing head may be contaminated with foreign substances such as dust and air bubbles. As an inner diameter of a liquid path communicating with an orifice formed on the printing head is small on the order of a few tens of micrometer, there is the fear of preventing a flow of ink passing through the liquid path by the depositing of the foreign substances on the interior wall of the liquid path when such substances arrive in the liquid path, resulting in the decreased efficiency of ink ejection and the decreased responsivity of ink ejection to printing signal. If such conditions become serious, ejection failures including a failed ink ejection may be caused as a result of clogging the orifice. The consistency of ink composition becomes increased when the ink ejection has not been performed even though ink remains in the liquid path of the inkjet printing apparatus. As a result, the ejection failures may be also caused by fixing the ink components on the liquid path.

There is also the possibility of the depositing of ink droplets, waterdrops, and foreign substance such as dust on a surface (also referred as an orifice surface) of ink-ejecting orifices of the inkjet printing head. Such a deposit may pull an ejected ink droplet to change the direction of ink ejection. As a result, an image degradation may be occurred.

For the sake of resolving those disadvantages, the inkjet printing apparatus has a specific configuration that cannot be found in other printing apparatuses. That is, an ejection-failure recovering system having means for cleaning ink in the liquid path and means for keeping the favorable condition of the orifice surface is provided on the inkjet printing apparatus.

Approaches for recovering the ejection failure by such a recovering system includes the introduction of fresh ink into the liquid path. For the introduction of fresh ink, there is a method known as "a preliminary ejection" or "an empty ejection", where ink which is not responsible for printing an image is ejected from the printing head into a predetermined ink receiver by driving an element that ejects energy for ejecting ink (an ejection energy generating element). Alternatively, there is another method known as "a pumping", where ink is forced to be discharged from an orifice by applying a predetermined pressure on the liquid path or by drawing in ink from the orifice by suction or the like.

Furthermore, there is a method known as "a wiping" using a wiping member that moves over an orifice surface of the inkjet printing head while maintaining continuous contact. In the wiping method, the orifice surface can be wiped clean of an ink droplet or a foreign substance (e.g., dust) being deposited in the vicinity of the orifice by relatively moving the printing head and the cleaning member.

For the wiping member, an elastic material such as urethane rubber is generally used. The performance of the wiping member depends on the quality of its material and the mechanical set-up condition. For maintaining the performance all the time, it is preferable to keep a surface of the wiping member clean. Thus, most of the inkjet printing apparatuses has a cleaning mechanism in which the wiping member wipes or scratches viscous ink or foreign substances and then pushes them to an absorber or the like so as to absorb the wiped or scratched one into the absorber.

If the ink being collected by the wiping member turns into the side of the printing head, the following problems may be caused. That is, for example, the accumulation of such viscous ink adheres on a pitch roller portion (a transfer means for a printing medium) and smears on the printing medium fed in place; the ink makes user's hands or the exterior of a printing head dirty during the replacement of heads or the insertion and withdrawal thereof from a carriage; or the ink makes an electrical contact surface of the printing head dirty to prevent the continuity in signal line, resulting in the adverse effect on the motion of the printing apparatus.

Hereinafter, we will describe several methods of cleaning a printing head of a printing apparatus in a concrete manner as prior art examples.

A method known as an ejection failure-recovery mechanism by suction (hereinafter, referred as "a recovery by suction") includes the steps of capping a nozzle portion (i.e., a portion of ejecting ink) of the printing head by an elastic member (i.e., a capping member) and then making the inside pressure of the cap negative to recover the clogging of the above nozzle portion by removing undesired materials such as debris and viscous ink therefrom. Another method known as an ejection failure-recovery mechanism by applying pressure to each of the nozzles to force the undesired materials out of the nozzle portion (hereinafter, referred as "a recovery by pressurization"). Following the recovery by suction or the recovery by pressurization, furthermore, there is a method of wiping an ink droplet by pressing an elastic member against the face (i.e., a surface where ink-ejecting orifices are formed) of the printing head to entirely remove the ink droplet being remained on the face (hereinafter, referred as "a wiping"). The wiping operation may be automatically performed after the expiration of a predetermined time interval to prevent the problem of a deposition of fine spray of ink or the like emitted from the nozzles on the face of the printing head (i.e., the nozzle portion is covered with the accumulated ink mist, resulting in an ink-ejection failure).

In ordinary cases, a wiping means to be used in the wiping operation described above is an elastic member formed as a sheet of rubber. The elastic member wipes the surface of the printing head in the direction perpendicular or parallel to a row of ink nozzles (i.e., ink-ejecting orifices) in accordance with the form of the printing head. Furthermore, there is another elastic member having its narrowed or broaden width with respect to that of the face of the printing head.

In the above wiping means, however, there is the fear of the laying-up of viscous ink on a surface of the wiping member as a result of increasing the viscosity of ink being adhered on that surface when the printing apparatus keeps on printing (i.e., character recording or the like) over an extended time period. If the wiping member is narrower than the face of the printing head, there is the fear of the deposition of ink on a portion of the face where the wiping member does not contact with. In this case, a sheet of printing paper may be smudged as a result of rubbing the paper with the printing head by the paper's movement. If the wiping member is broader than the face of the printing head, there is the fear of the deposition of viscous ink on the edge portion of the face. When the ink is more deposited on the face, a pinch roller may receive any excess amount of the deposited ink. Thus, there is the fear that the ink may be transferred from the pitch roller to a sheet of printing paper.

The problem of the ink deposition on the wiping means can be solved by installing a wiper cleaner for cleaning the wiping means in place. It means that the wiper cleaner keeps the wiping means clean at all times.

However, we should take another measures against the problem that the ink is deposited on the portion of the face of the printing head where the wiping member cannot contact with. Viscous ink may be deposited on a particular place of the face which cannot be contact with the wiping member unless the relative position between the printing head and the wiping means is changed. Therefore, there is the idea that the relative position between the printing head and the wiping means is delicately displaced at the time the wiping operation begin to start to decrease the deposition of viscous ink deposition even in small quantities. Furthermore, an additional wiping means which is broader than the printing head may be installed to prevent the deposition of viscous ink on the face. However, there is no fundamental solution of the problem of depositing ink on the edge of the face.

Each of FIGS. 29 and 30 illustrates an inkjet printing head and a carriage for explaining the problem of depositing ink on the edge of the face in the printing head.

In inkjet printing heads H (111, 112) to be mounted on a carriage C, as shown in FIG. 29, an electric contact portion 23 having contacts 22 to receive driving signals for the printing head is provided on the upper portion of the side of the printing head 21. On the other hand, a carriage C has insertion portions for receiving the printing heads H (111, 112). These insertion portions have their respective electric contact portions 24, 25 with contact points 22A, respectively. The contact point 22A is responsible for transmitting a signal to the printing head H by contacting with the electric contact portion 23 on the head's side. In addition, the electric contact portions 24, 25 establish connection with a control system on a main body of the printing apparatus. As shown in FIG. 29, the printing head H can be placed in the carriage C through an opening in the direction shown by the arrow.

It is noted that an ink deposit I can be found on the side of the head H because the wiping means pushes the ink deposit I aside at the time of cleaning operation.

When the printing head H with the ink deposit I is inserted in the carriage C or withdrawn from the carriage C, there is a possibility that the ink deposition I on the side 21 of the head H comes in contact with the electric contact portions 24, 25 of the carriage C. A short circuit happens when the ink deposit I comes in contact with at least one of the electric contact portions 24, 25 increasing the risk of damage to the control system of the body.

SUMMARY OF THE INVENTION

An object of the present invention is to provide a cleaning device and a cleaning method for an inkjet head, a wiper used in such device and method, and an inkjet printing apparatus.

In the first aspect of the present invention, there is provided a cleaning device for an ink-jet printing head having an ink-ejecting surface where a plurality of ink-ejecting ports is formed for ejecting ink, in which the ink-ejection surface is cleaned by a relative movement between the printing head and the cleaning device, the cleaning device comprising:

a deposit-removing member facing to a side of the printing head, where the side of the printing head extends substantially in the direction along a relative movement between the printing head and the cleaning means and positioned along an edge of the ink-ejecting surface.

In the second aspect of the present invention, there is provided a method of cleaning an ink-ejecting surface of a printing head by utilizing a relative movement with the printing head having the ink-ejecting surface where a plurality of ink-ejecting ports is formed for ejecting ink, comprising a step of:

cleaning the ink-ejecting surface of the printing head, concurrently with removing a deposit on a side of the printing head, where the side is located along an edge of the ink-ejecting surface.

In the third aspect of the present invention, there is provided an inkjet printing apparatus that forms an image on a printing medium using a printing head having an ink-ejecting surface where a plurality of ink-ejecting ports is formed for ejecting ink, comprising:

a deposit-removing member which is able to perform a relative movement with a side of the printing head, where the side of the printing head is positioned along an edge of the ink-ejecting surface.

In the fourth aspect of the present invention, there is provided a wiper provided in an inkjet printing apparatus using an ink-jet printing head having an ink-ejecting surface where a plurality of ink-ejecting ports is formed for ejecting ink, comprising:

a deposit-removing member which is able to perform a relative movement with a side of the printing head, where the side of the printing head is positioned along an edge of the ink-ejecting surface.

According to the present invention, the side of an inkjet printing head can be wiped to prevent an ink deposition caused by an increase in the viscosity of ink. As a result, there is no possibility of making a sheet of printing paper dirty.

A wiping operation for the side of the head according to the present invention includes: the relative movement of an elastic member keeping contact with the side of the head; and the relative movement of the elastic member at a location some distance from the side of the printing head in order to remove the ink deposit. Regarding the latter, we refer the relative movement as one having the spacing or clearance between the two. In addition, it is noted that a wiping for an orifice surface of the printing head is the type of performing a sliding-contact cleaning.

Furthermore, the present invention makes an inkjet printing apparatus as compact as possible with the ability of preventing a deposition of viscous ink by providing a scraper which is able to protrude to the side of the printing head and performs the relative movement against the printing head. Consequently, there is no possibility to dirty the printing medium, the exterior, and the user's hand, and also there is no possibility to produce the adverse effect (e.g., less or no continuity of signal lines as a result of making an electric contact surface of the head) on the operating characteristics of the printing head.

The scraper protrudes to the side of the head by the motion of a capping member that performs the relative movement against the printing head, so that there is no need to install an extra mechanism for operating the scraper. Therefore, it is possible to simplify the configuration.

In addition, there is no need to provide an additional part as a result of providing the scraper as a part of the capping member that performs the relative movement against the printing head.

It is possible to prevent the accumulation of viscous ink by appropriately keeping the scraper in slide-contact with the side of the printing head as a result of providing the scraper as an elastic member.

A printing quality can be improved by appropriately ejecting ink as a result that the printing head includes electro-thermal conversion elements that generate thermal energies for ejecting ink from the corresponding orifices.

The above and other objects, effects, features and advantages of the present invention will become more apparent from the following description of the embodiments thereof taken in conjunction with the accompanying drawings

BRIEF DESCRIPTION OF THE DRAWINGS

By way of example and to make the description more clear, reference is made to the accompanying drawings in which.

DETAILED DESCRIPTION OF THE PREFERRED EMBODIMENTS

Hereinafter, preferred embodiments of the present invention will be described in detail with reference to the accompanying drawings.

In the following embodiments, the term "ink" herein used refers ink having a composition that includes an electrically conductive color material (e.g., carbon, ink dye) or an electrically conductive material (e.g., conductive fixing material, conductive liquid material). In addition, the term "the side" of a printing head refers at least one surface being laterally positioned in the direction of the respective movement of a carriage or a printing head with a cleaning member. That is, the side of the printing head is substantially parallel to the direction of the respective movement.

The present inventors have been observed that a state of the ink deposit formed by the depositing of ink on the side of the printing head. As a result, a width of the ink deposit from the orifice surface to the side was about 3 mm and a height of the ink deposit laterally protruding from the side was about 2.1 mm. Therefore, it is preferable that a structural component for removing the ink deposit is of about 3 mm or more in length and provided so as to face the side of the printing head. It is also preferable that such a structural component extends from the side to the opposite one with respect to the orifice surface. In addition, the distance from the side of the printing head to the structural component for removing the ink deposit depends on the amount of the ink deposit to be removed. Thus, the distance is theoretically in the range of 2 mm or less to allow the movement of the ink deposit from the side at a place facing to the side. In actuality, however, the distance may be in the range of 1 mm or less. In the following embodiments, by the way, a width of slit-cut described later is typically 0.5 mm but approximately 0.3 to 0.7 mm.

A material of the structural component for removing the ink deposit on the side of the printing head may be a rigid material, a plastic material, a rubber material, or the like. Preferably, it may be of having elasticity when it is constructed so as to integral with a portion of performing a slide-contact cleaning of the orifice surface of the printing head.

First Preferred Embodiment

Figure 1:
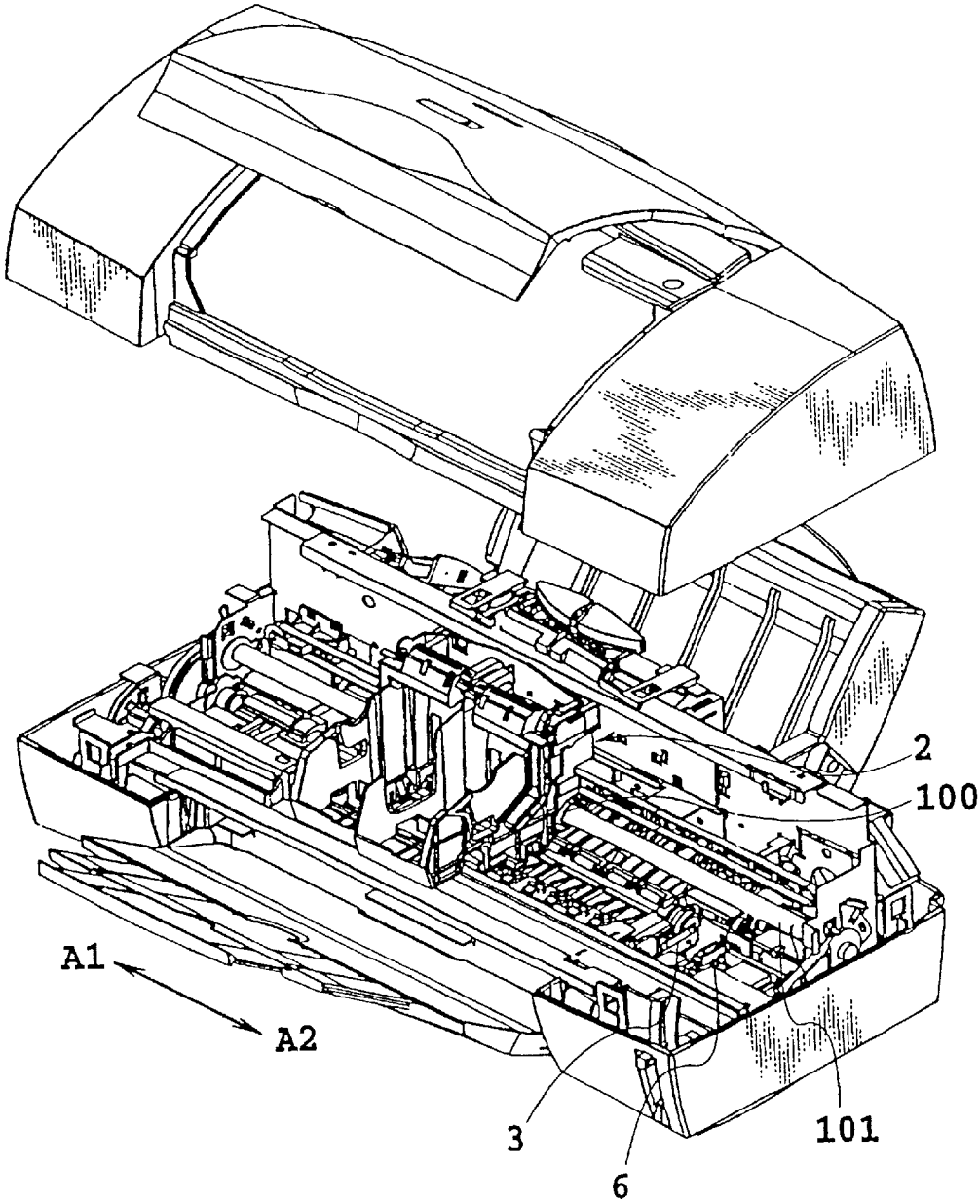
FIG. 1 is an exploded perspective view of a printing apparatus as a first preferred embodiment of the present invention.
Figure 2:
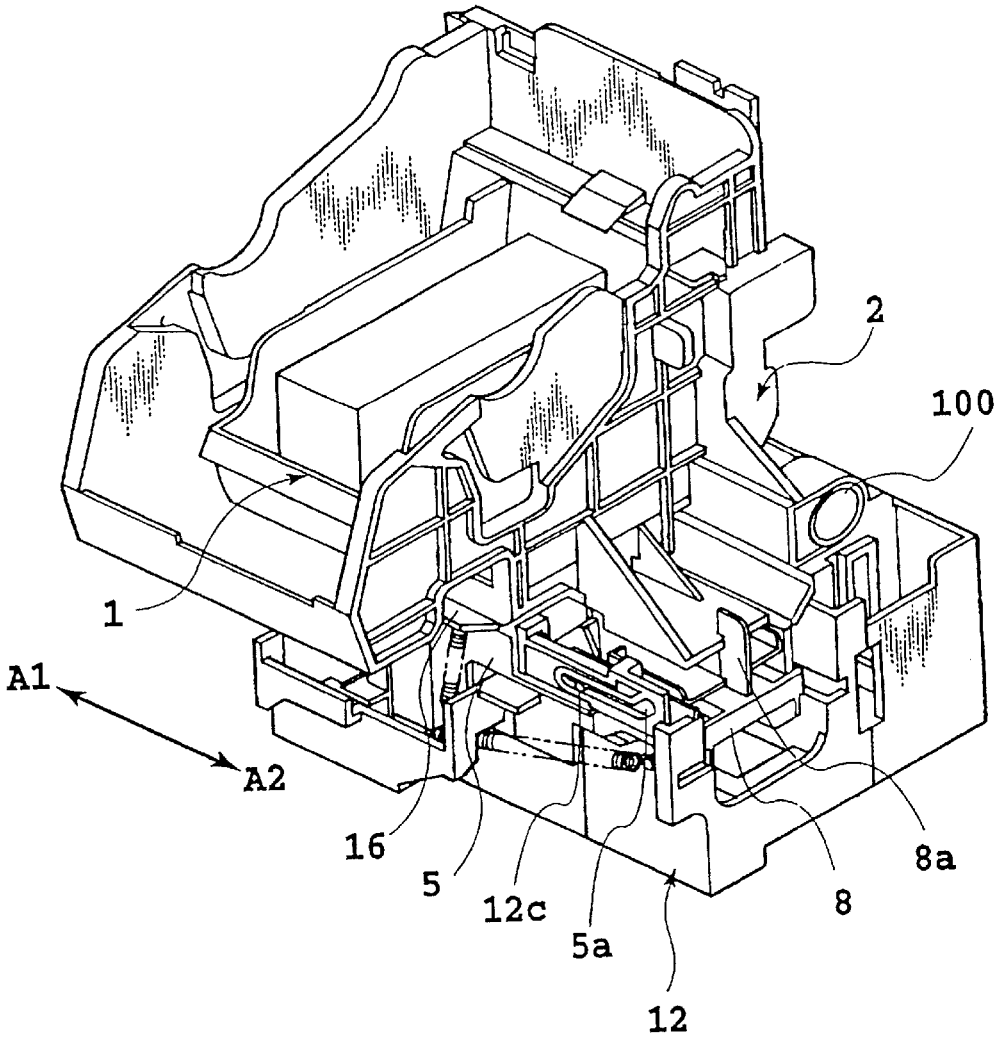
FIG. 2 is a perspective view of a carriage and a wiping mechanism portion of the printing apparatus shown in FIG. 1.
Figure 3:
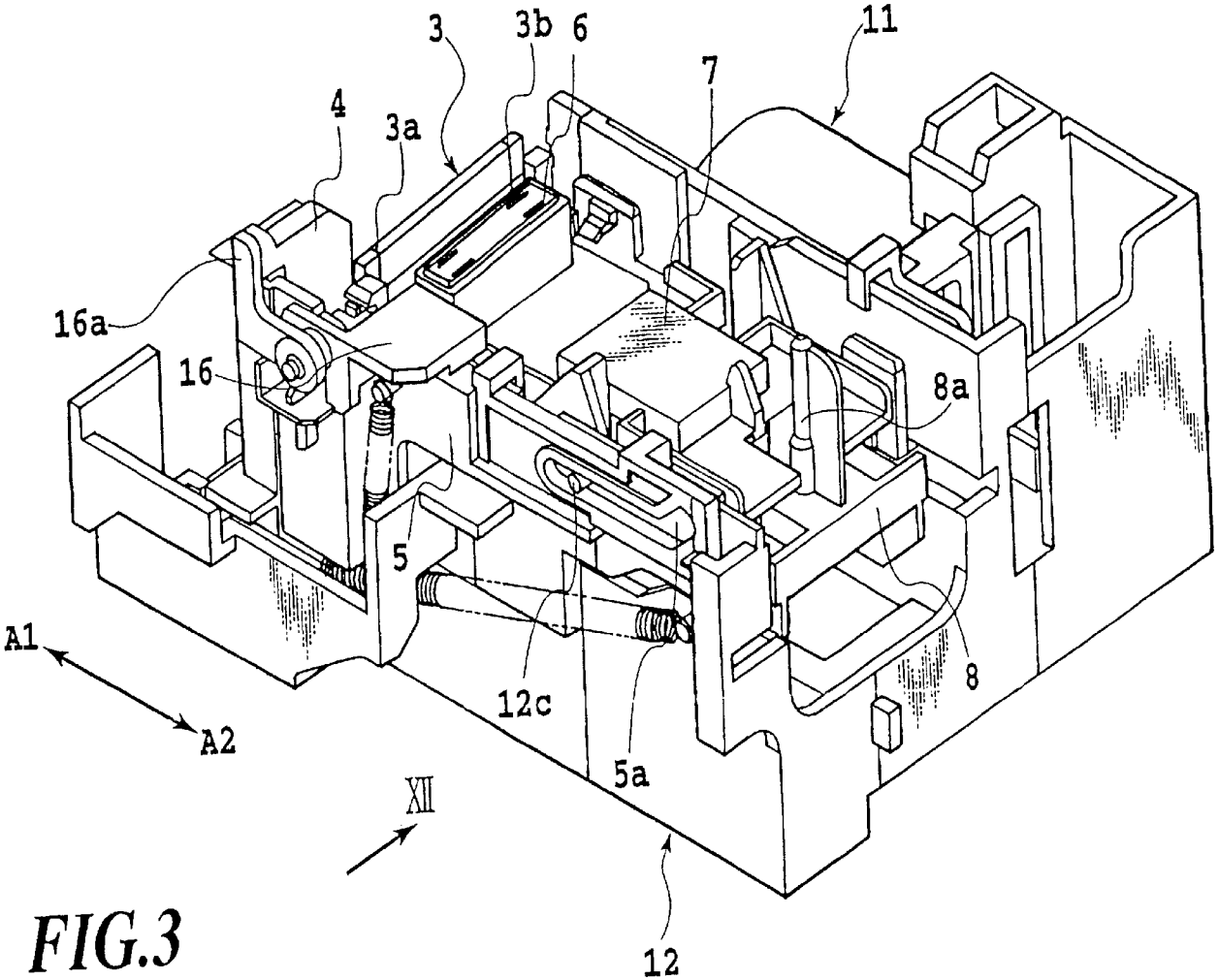
FIG. 3 is an enlarged view of the wiping mechanism portion shown in FIG. 2.

FIG. 1 is an exploded perspective view of a printing apparatus as a first preferred embodiment of the present invention. FIG. 2 and FIG. 3 are enlarged perspective views of a capping portion of the printing apparatus shown in FIG. 1.

Figure 4:
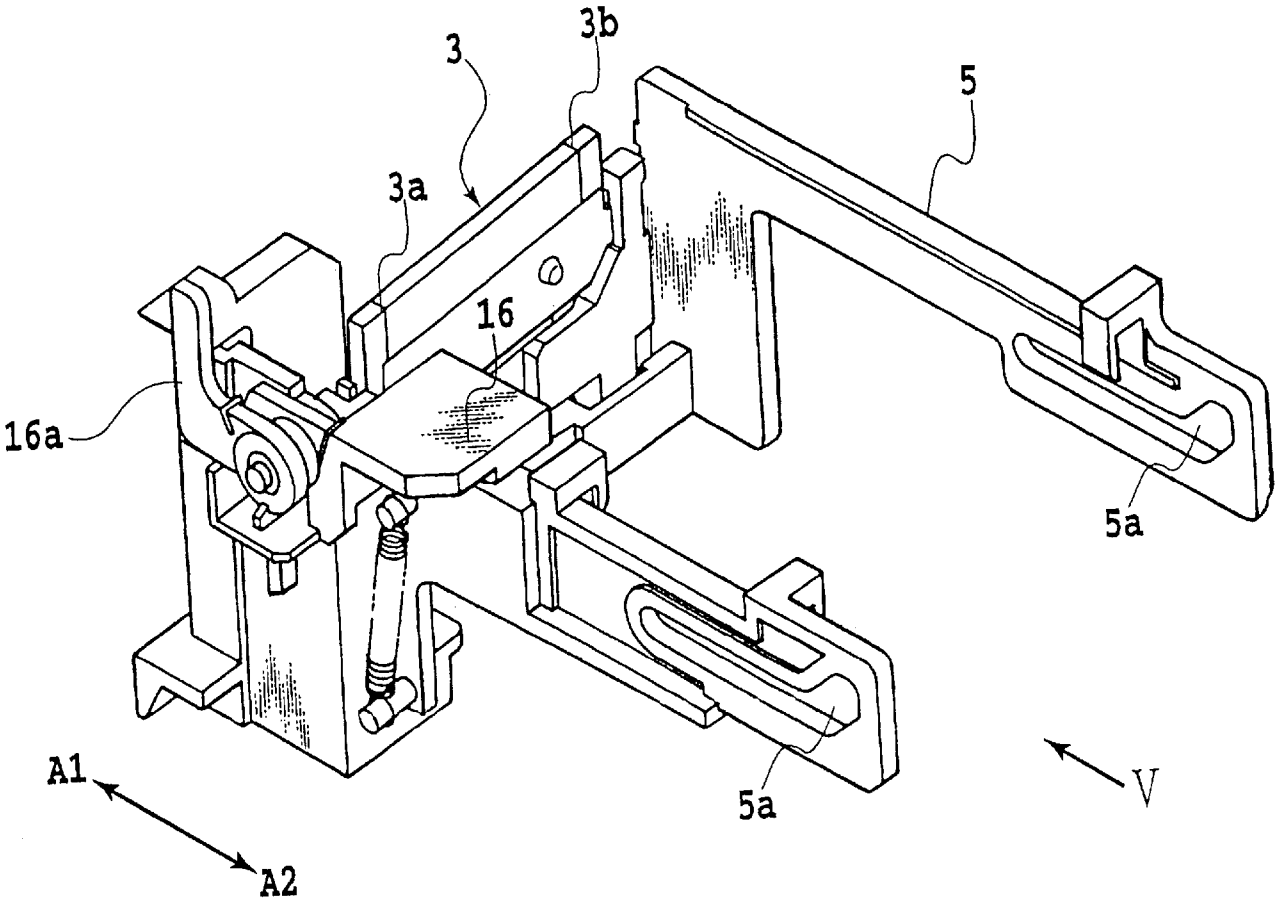
FIG. 4 is an enlarged view of a wiper portion of the wiping mechanism portion shown in FIG. 3.
Figure 5:
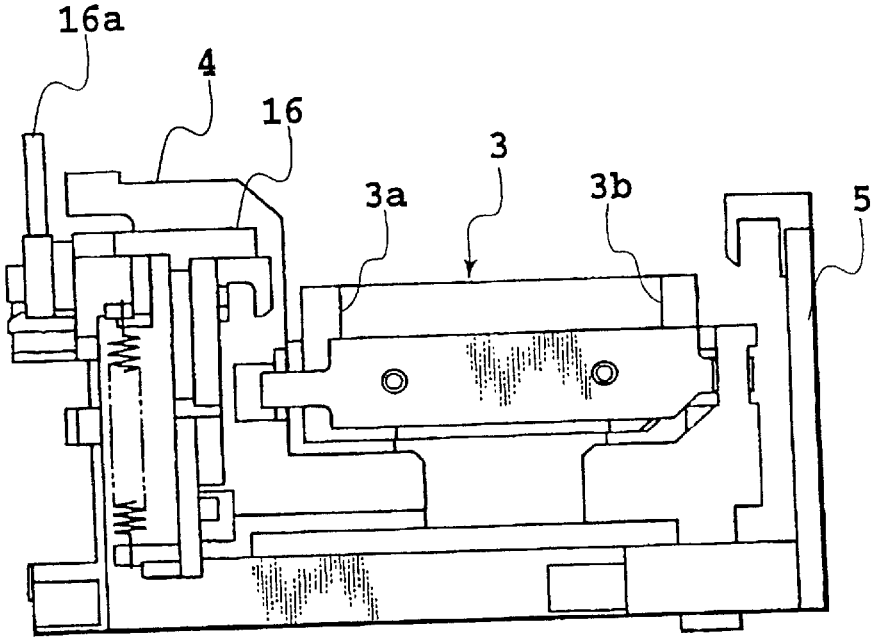
FIG. 5 is a plan view of the wiper portion taken in the direction shown by the arrow V in FIG. 4.

Furthermore, FIG. 4 and FIG. 5 are enlarged views of a wiper portion of the wiping mechanism portion of the printing apparatus shown in FIG. 1.

In FIG. 2, reference numeral 1 denotes a printing head which is able to eject ink, 2 denotes a carriage that moves reciprocally in the main-scanning direction as indicated by the arrows A1 and A2. Two replaceable printing heads 1 are mounted on the carriage 2, and each of them may be provided as an inkjet cartridge by coupling with an ink tank.

In FIG. 3, reference numeral 6 denotes a cap, 7 denotes a cap-holder, and 8 denotes a cap slider.

In FIG. 4 and FIG. 5, reference numeral 3 denotes a wiper, 4 denotes a wiper-holder, 5 denotes a wiper-holder base, and 16 denotes a wiper-lock.

Figure 6:
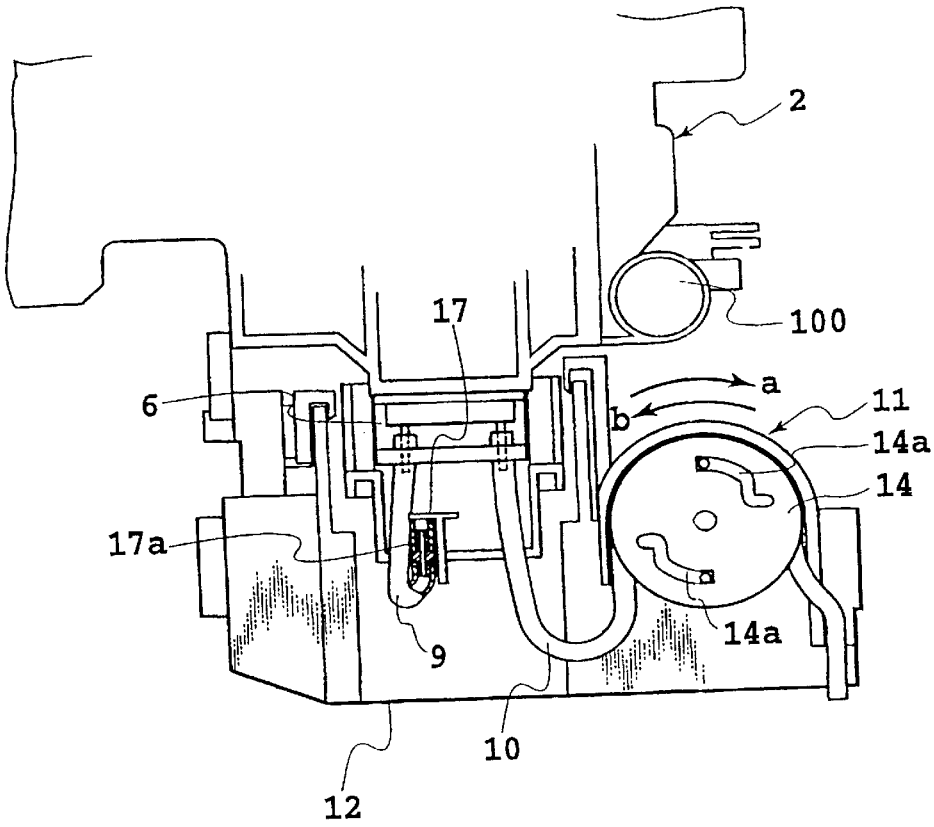
FIG. 6 is a side view of the inside of a pumping mechanism portion shown in FIG. 3.
Figure 7:
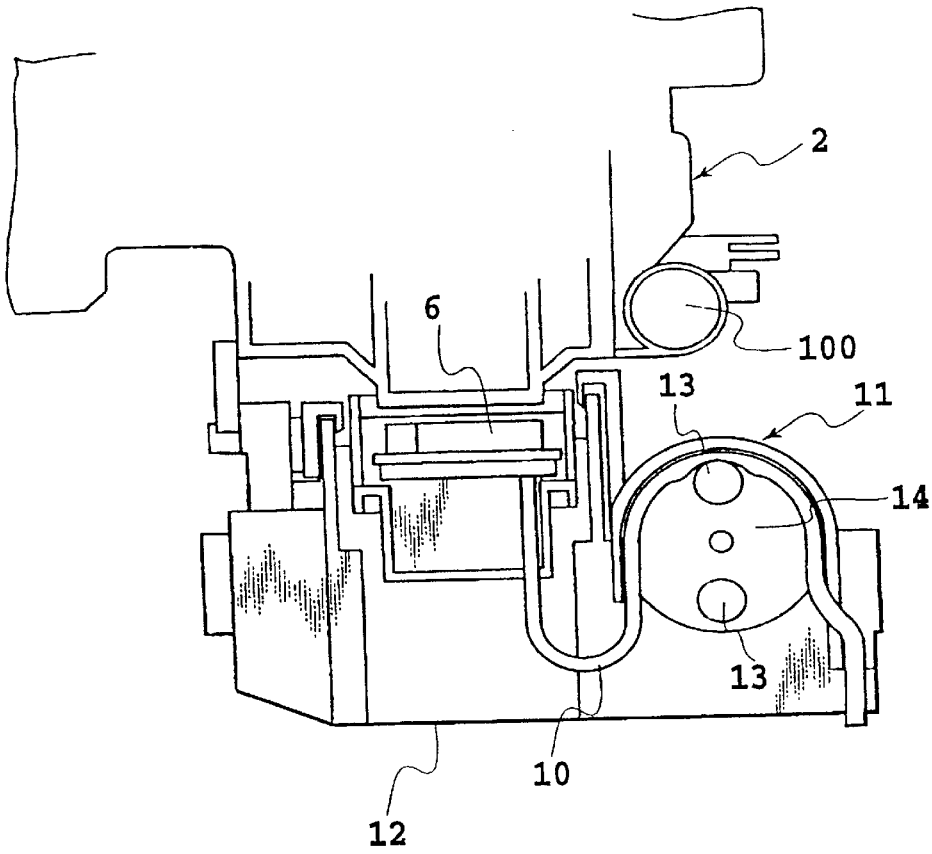
FIG. 7 is a side view of the inside of the pumping mechanism portion shown in FIG. 6.
Figure 8:
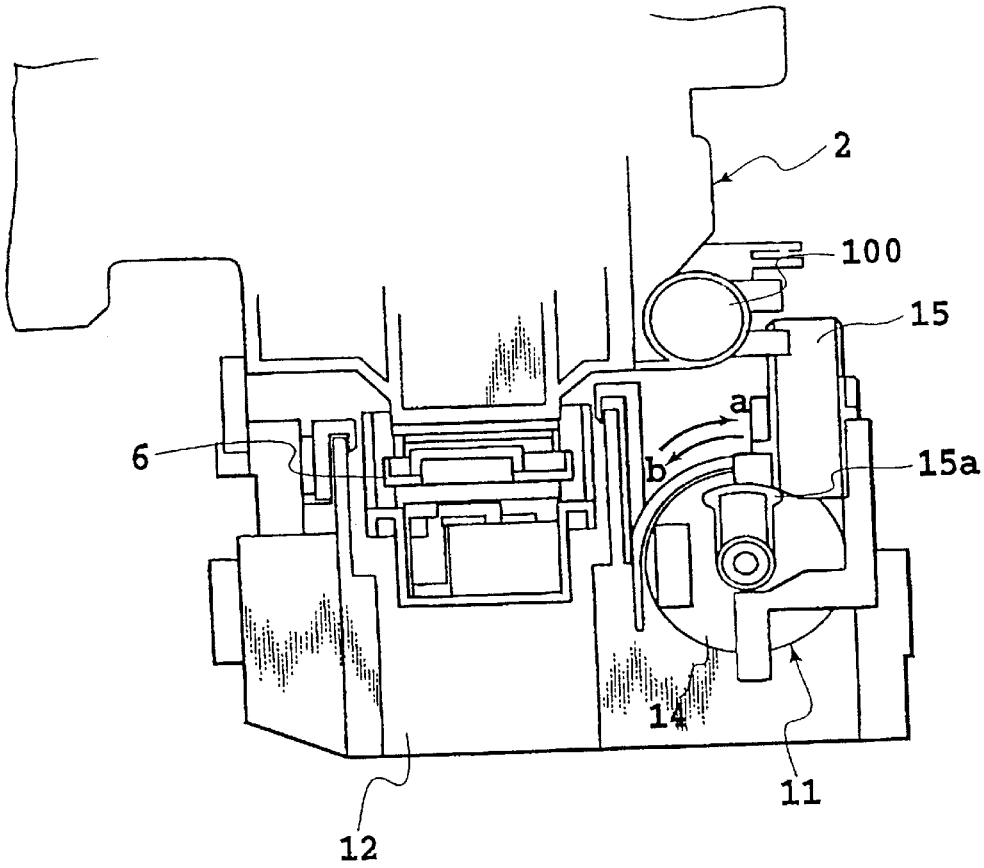
FIG. 8 is a side view of the pumping mechanism portion shown in FIG. 6.

Furthermore, FIG. 6, FIG. 7, and FIG. 8 are sectional views of a suction-pump portion, in which reference numeral 9 denotes an air-communicating tube, 10 denotes a suction tube, 11 denotes a suction pump, 12 denotes a recovery base, 13 denotes a suction roller, 14 denotes a roller holder, and 15 denotes a carriage lock. The carriage 2 has a shaft bearing 100 through which a guide shaft 101 is passed so as to guide the movement of the carriage 2 reciprocally in the direction along the arrows A1 and A2 without restraint.

Figure 12:
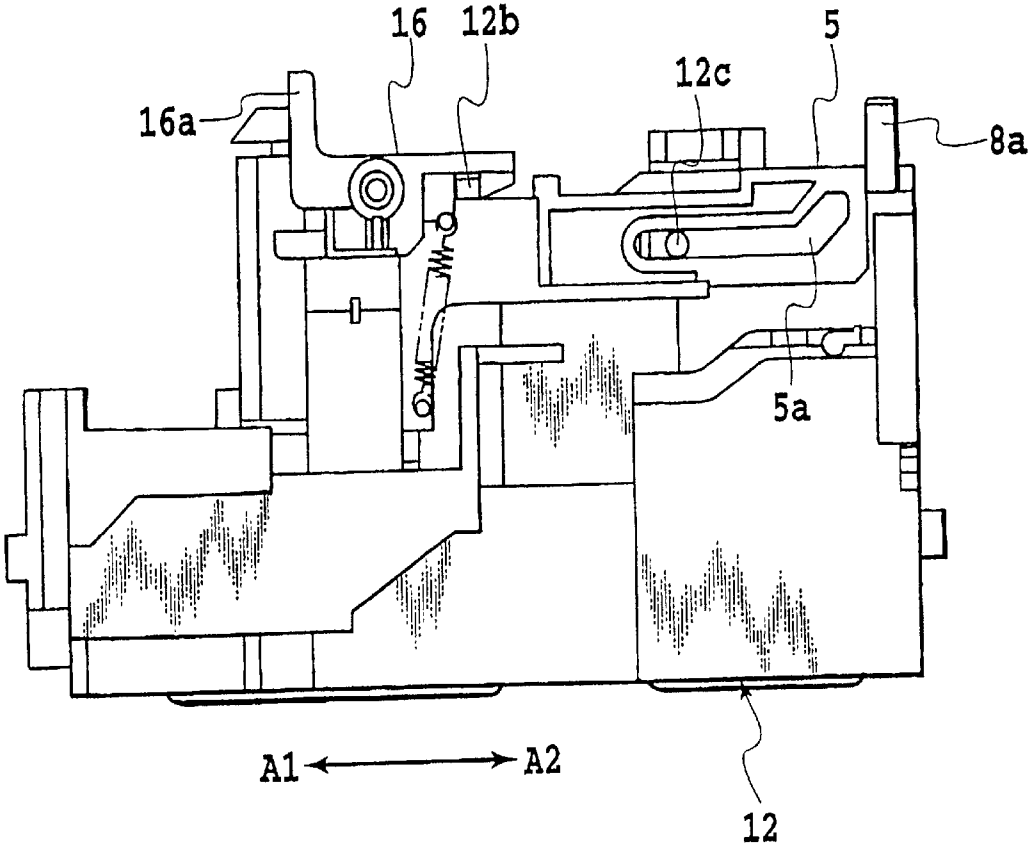
FIG. 12 is a plan view of the wiping mechanism portion taken in the direction shown by the arrow XII in FIG. 10.
Figure 13:
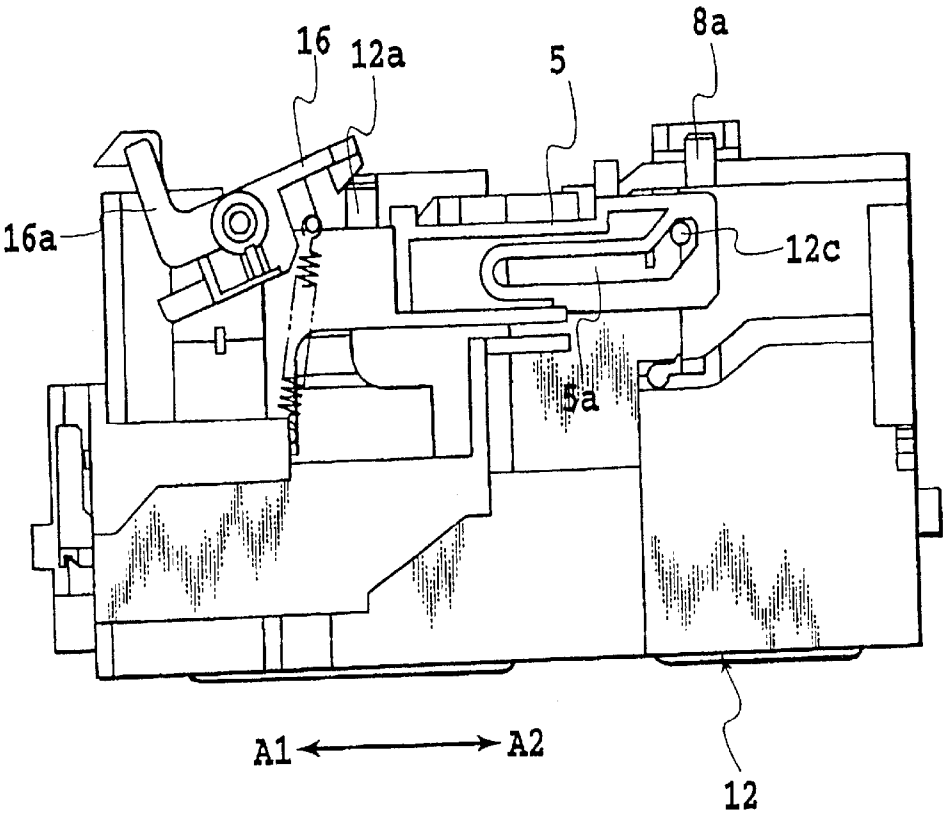
FIG. 13 is a front view of a wiper-holder base of FIG. 12 in a state of moving downward.

The recovery base 12 is provided at a predetermined position in the right-hand part (i.e., on the arrow A2 side) of the interior of a main body of the printing apparatus. The cap-slider 8 on the recovery base 12 has a protruded portion 8*a*. The carriage 2 pushes the protruded portion 8*a* as shown in FIG. 2, so that the cap slider 8 is able to move in the direction of the arrow A2 in conjunction with the movement of the carriage 2. The cap holder 7 that keeps hold of the cap 6 moves along the arrow A2 direction in conjunction with the cap slider 8 and concurrently moves upward so that the cap 6 caps the printing head 1. The wiper-holder base 5 having the wiper holder 4 with the wiper 3 is able to slide in conjunction with the movement of cap slider 8 and concurrently moves upward and downward as a result of a guide motion of a guide groove 5*a* and a pin 12*c* on the side of the recovery base 12 as shown in FIG. 12 and FIG. 13. The wiper 3 of the present embodiment is made of a sheet of rubber.

The printing head 1 of the present embodiment is constructed so as to eject ink from orifices (ink ejecting ports) formed on a face 1A (see FIG. 11) that points downward. A plurality of orifices is formed in series on the face 1A in the direction that crosses the main-scanning direction (i.e., in the direction of the arrows A1 or A2). By repeating the movement of the printing head 1 in the main-scanning direction (the arrow A1 or A2 direction) and the movement of a printing medium (not shown) in the direction perpendicular to the main-scanning direction, an image is printed on the printing medium by ink dots. The printing head 1 can be constructed, for example so as to have electro-thermal conversion elements for applying thermal energies on ink to eject ink from the orifices.

Figure 9:
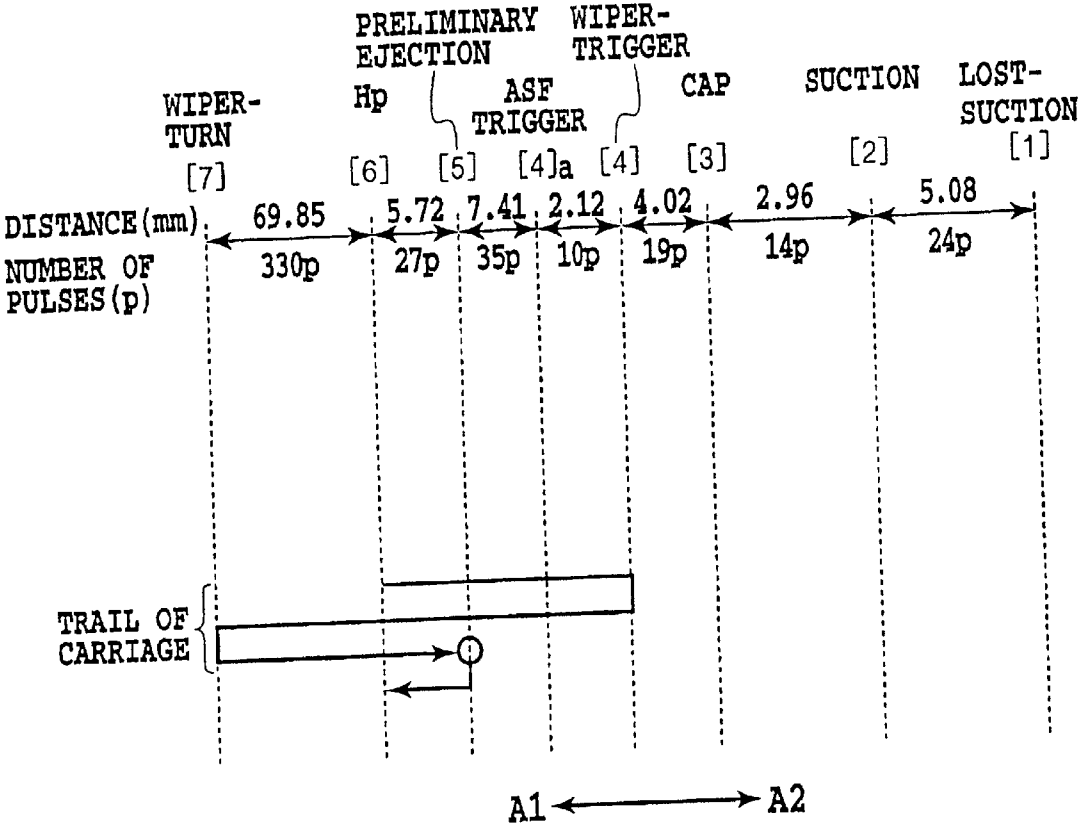
FIG. 9 is a graphical representation for illustrating a recovering operation in the printing apparatus shown in FIG. 1.

In this embodiment, a home position (HP) of the printing head 9 is established at a position [6] (see FIG. 9) which is displaced in the right-hand (i.e., the allow A2 direction) from a printing region of the printing medium. A predetermined recovering motion can be performed at an area between the positions [1] and [7] that include the position [6]. The printing region is on the left-hand (i.e., the allow A1 direction) of the position [7]. In FIG. 9, "distance (mm)" is the moving distance of the carriage 2, "the number of pulses (P)" corresponds to the number of driving-pulses generated for a pulse motor for shifting the position of the carriage 2. The motion of the printing apparatus at each of the positions will be described later.

First, we will describe a configuration of the suction pump 11.

The suction pump 11 is, for example a tube pump as disclosed in Japanese Patent Laying-open No. 53-106802 (1978). If the roller holder 14 rotates in the direction of the arrow a in FIG. 6, the suction roller 13 performs a relative movement along a cam 14*a* of the roller holder 14 in the direction of the arrow b. Then, the suction roller 13 rotates in the direction of the arrow a in conjunction with the roller holder 14 under the condition of keeping its location at a position on the side of a peripheral portion of the roller holder 14 by means of an end of the cam 14*a* in the direction of the arrow b. Therefore, the suction roller 13 presses the suction tube 10 positioned between the recovery base 12 and the suction roller 13 to generate an negative pressure in the cap 6 connected with the suction tube 10. If the roller holder 14 rotates in the direction of the arrow b in FIG. 6, the suction roller 13 performs a relative movement along the cam 14*a* of the roller holder 14 in the direction of the arrow a. Then, the suction roller 13 rotates in the direction of the arrow b in conjunction with the roller holder 14 under the condition of keeping its location at a position on the inner side of the roller holder 14 in its radial direction by means of an end of the cam 14*a* in the direction of the arrow b. Therefore, the suction roller 13 rotates at a position where it cannot press the suction tube 10, resulting that a negative pressure cannot be generated in the cap 6 connected with the suction tube 10. The carriage lock 15 is constructed so as to be operated in conjunction with the suction pump 11 through a friction member 15*a*, so that it locks into place when the suction pump 11 rotates in the reverse direction (the arrow b) and it unlocks into place when the suction pump 11 rotates in the positive direction (the arrow a).

Next, configurations of the cap 6 and the periphery thereof will be described bellow.

As shown in FIG. 3, the cap 6 is held on the cap holder 7 which is retained by the cap slider 8 through a cap spring. If the carriage 2 moves across the right-hand (the arrow A2 direction) of the position (CAP) [3], the cap 6 is moved upward for capping the printing head 1 by the cap holder 7. In addition, the cap 6 includes two openings as shown in FIG. 6. The cap 6 establishes connection with an end of the suction tube 10 through its opening and an end of the air-communicating tube 9 through its another opening.

The other end of the air-communicating tube 9 is inserted into the cap slider 8, and also a valve 17 is provided on its tip through a packing 17*a*. The cap slider 8 slides over the valve 17 so as to open or close the valve 17 as a result of pushing the cap slider 8 with a motion of the carriage 2. That is, the valve 17 is in the closed state at the position [2] of FIG. 9, while it is in the opened state at the position [1]. Therefore, it becomes possible to perform a recovery operation at the position [2] where the printing head 1 is capped and the air-communicating tube 9 is closed. In the recovery operation, the suction pump 11 sucks up ink in the orifices of the printing head 1. It also becomes possible to perform a lost suction in which the suction pump 11 sucks up ink in the cap 6 at the position [1] where the printing head 1 is capped and the air-communicating tube 9 is opened.

It is possible to perform a preliminary ink-ejection in which the printing head 1 ejects a predetermined amount of ink which does not contribute to any print at the position [5] in FIG. 9 where the cap 6 is located under the printing head 1. In addition, the position [6] is defined as the output timing of an ASF trigger for automatically feeding the printing medium.

Figure 10:
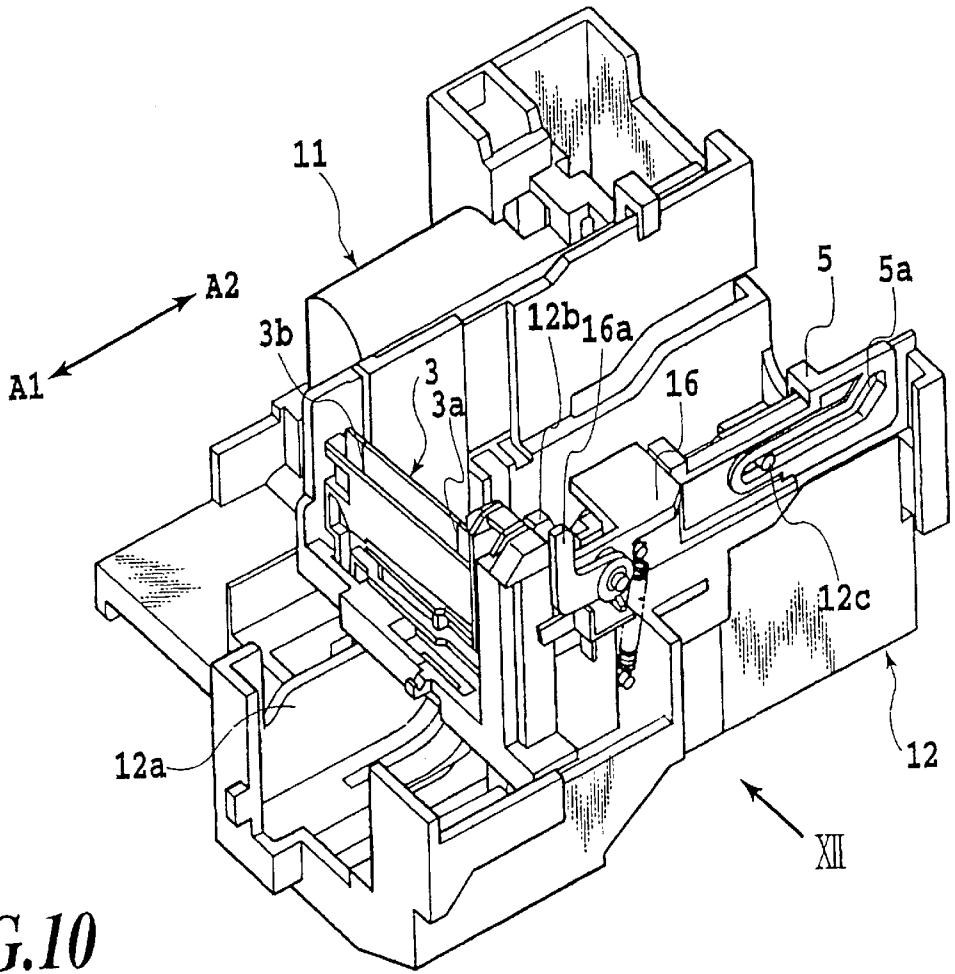
FIG. 10 is a perspective view of the wiping mechanism portion shown in FIG. 3.

The cap slider 8 and the wiper-holder base 5 are constructed so as to work together. If the carriage 2 is positioned at the right-hand outside (in the arrow A2 direction) of the position [4], as shown in FIG. 10 and FIG. 12, the wiper holder base 5 lifts the wiper 3 to a high level where the wiper 3 makes contact with the printing head 1 by means of the cam 12*a* (see FIG. 10) of the recovery base 12, the guide groove 5*a*, and the pin 12*c*,. Consequently, the wiper lock 16 is engaged with a hook 12*b* (see FIG. 12) of the recovery base 12. In the position [4], that is, the wiper 3 is in place where it is able to make contact with the printing head 1 when the carriage 2 moves from the left-hand to the right-hand of the position [4]. In the position [7], on the other hand, the wiper 3 is in place where it cannot make contact with the printing head 1 as a result of releasing the lock of the wiper lock 16 as described later when the carriage 2 moves from the right-hand to the left-hand of the position [7].

A series of the motion will be described below.

If the power to the printing apparatus is turned on, the suction pump 11 starts to rotate in the right direction (the arrow a direction) by means of a driving source (not shown). As a result, the carriage lock 15 is released from the locked state as shown in FIG. 8. After releasing the carriage lock 15, the carriage 2 moves toward the wiper-turning position [7] in FIG. 9.

The wiping-start position is established between the cap position [3] and the print-standby position (HP) [6]. During the period of moving the carriage 2 to the print-standby position [6], the cap 6 is opened to perform wiping motion of the wiper 3 on the printing head 1. If the carriage 2 moves to the position [7], a protrusion 2*a* (see FIG. 11) formed on the carriage 2 makes contact with a wiper-lock lever 16*a* to release the engagement between the wiper lock 16 and the hook. 12*b* of the recovery base 12. As a result, the wiper 3 moves downwardly from the printing head 1 to the standby position (see FIG. 13). In a state shown in FIG. 13, the wiper 3 cannot make contact with the printing head 1.

If the necessity of wiping arise during the printing motion, the carriage 2 moves from the printing region to the position [4] to engage the wiper lock 16 on the hook 12*b* of the recovering base 12. Therefore, the wiper 3 is kept at the position where it makes contact with the printing head 1. Then, the carriage 2 shifts its position to the position [7] again to perform a wiping movement.

Figure 11:
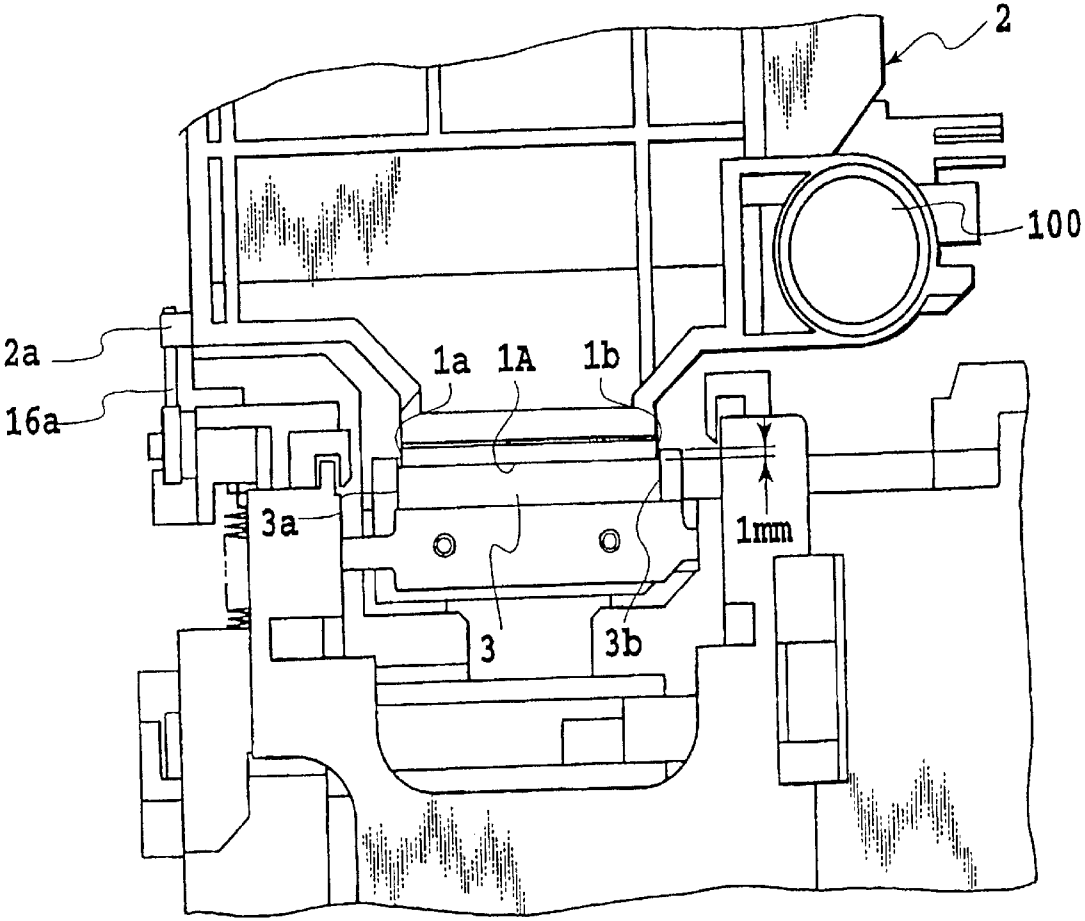
FIG. 11 is an enlarged view of a main portion for illustrating the relationship between the wiper and the printing head shown in FIG. 10.

Referring now to FIG. 11, there is shown the details of the periphery of the wiper 3 at the time of wiping movement.

In this embodiment, sides 1*a*, 1*b* and a face 1A (i.e., a surface on which orifices (ink ejection holes) are formed) of each of two printing heads 1 mounted on the carriage 2 occupy the same position in a side view as FIG. 11. In the wiper 3, as shown in FIG. 11, there are wiper slit portions 3*a*, 3*b* corresponding to the sides 1*a*, 1*b* of the printing head 1. That is, the slit portions 3*a*, 3*b* are formed on the positions facing to the sides 1*a*, 1*b* of the printing head 1, respectively. In addition, each of the slit portions 3*a*, 3*b* is linearly formed along the predetermined area from a free end (the top) to a fixed end (the bottom) of the wiper 3 in the shape of a sheet.

As described above, the wiper 3 is kept contact with the printing head 1 when the carriage 2 shifts its position to the position [4] from the left-hand. In this case, it is preferable that the length of overlap between the face 1A of the printing head 1 and the side of the wiper 3 in the vertical direction is about 1 mm. The wiper 3 is able to wipe minute ink droplets on the face 1A when the printing head 1 moves along a guide axis 101 under the condition of keeping about 1 mm of the overlap.

Ink droplets moving toward the sides 1*a*, 1*b* of the face 1A can be scraped off by the wiper-slit portions 3*a*, 3*b*. That is, a portion between the slit portions 3*a*, 3*b* in the wiper 3 wipes the face 1A clean accompanied by a distortion corresponding to the overlap with the face 1A. A left-side portion forming the slit portion 3*a* in FIG. 11 performs the relative movement along the side 1*a*, so that it removes the deposit on the side 1*a* without causing a warp in the wiper 3. A right-side portion forming the slit portion 3*b* in FIG. 11 performs the relative movement along the side 1*b*, so that it removes the deposit on the side 1*b* without causing a warp in the wiper 3.

Consequently, there is no possibility of remaining any minute ink droplet on the face 1A and also on the sides 1*a*, 1*b* thereof. Thus, it is possible to perform a print such as a character print, satisfactorily all the time.

By the way, we define the portion of the wiper 3 for wiping the face 1A as a first elastic member and another portion of the wiper 3 for wiping the sides 1*a*, 1*b* as a second elastic member. These two elastic members may be made of different elastic materials. In addition, the wiper 3 and the printing head 1 may perform their relative movements only at the time of wiping, so that it is possible to move the wiper 3 against the printing head 1 and mechanisms, directions, and the like of the relative movements cannot be specified only by the present embodiment.

In the present embodiment, furthermore, the printing apparatus may be equipped with a head for ejecting a treatment solution for coagulating or insolubilizing the color materials in ink. Such a head can be constructed by the same way as that of the printing head 1. In addition, a face (i.e., a surface where orifices are formed for ejecting the treatment solution) and the sides of the head can be wiped with the wiper 3 or the like.

Second Preferred Embodiment

Figure 14:
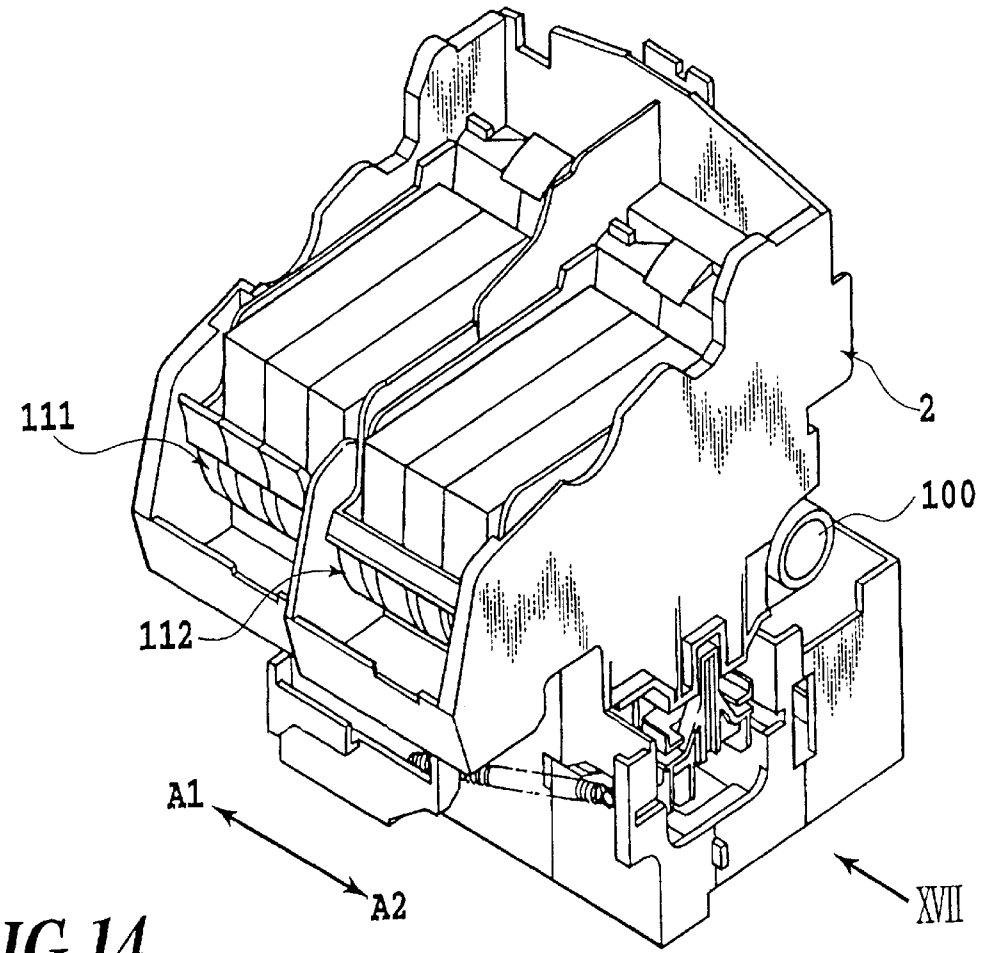
FIG. 14 is a perspective view of a carriage and a wiping mechanism portion in accordance with a second preferred embodiment of the present invention.

FIG. 14 is a perspective view of a main portion of a printing apparatus in accordance with a second preferred embodiment of the present invention.

In this embodiment, there are two different removable printing heads 111, 112 mounted on a carriage 2. These printing heads 111, 112 are placed in the different positions with a deviation of about 4 mm in the direction of transferring a sheet of printing paper. In the figure, the head 111 is a photo head for ejecting magenta ink, cyan ink, and black ink in small concentrations and the head 112 is a color head for ejecting magenta ink, cyan ink, and yellow ink in high concentrations. A combination of these heads 111, 112 allows a print such as printing with six deferent color inks and provides a beautiful photographic print. Each of these heads 111, 112 may be provided as an inkjet cartridge by coupling with an ink tank. In addition, the photo head 111 may be displaced with a black head having an ink tank for black ink to allow a high speed text printing or a high speed business color print.

Figure 15:
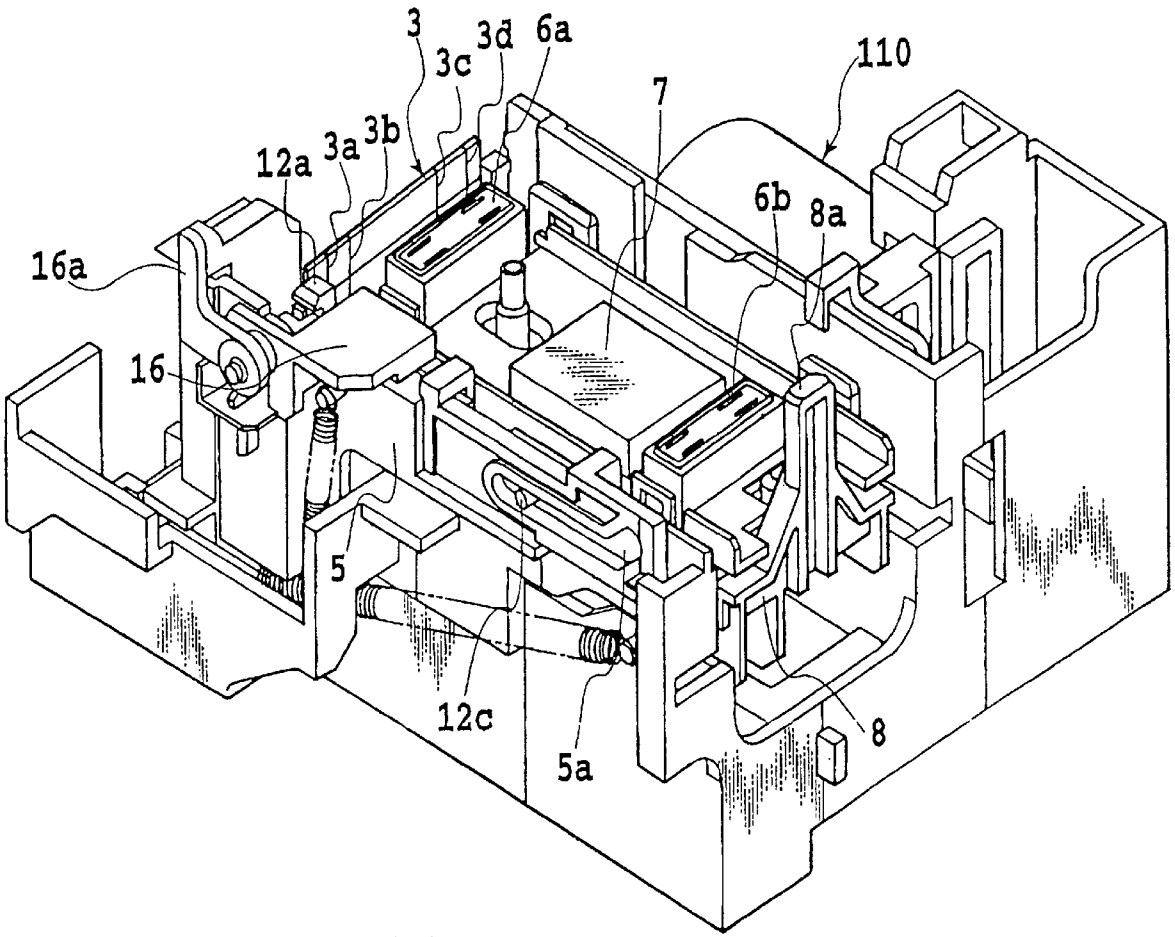
FIG. 15 is a perspective view of the wiping mechanism portion shown in FIG. 14.

FIG. 15 is a perspective view of an suction pump 110 used in the present embodiment. The suction pump 110 is constructed by adding a roller holder corresponding to one additional system on the suction pump of the first embodiment. The suction pump 110 draws two systematically different suction tubes respectively connected with caps 6*a*, 6*b* to perform the recovery of the heads 111, 112 in response to the direction of rotation. The caps 6*a*, 6*b* adapt to their respective heads 111, 112. Also, the suction pump 110 comprises roller holders 13*a*, 13*b* for the total of two systems, so that the part of the roller holder 13*a* is constructed as shown in FIG. 20 while the part of the roller holder 13*b* is constructed as shown in FIG. 21.

Figure 20:
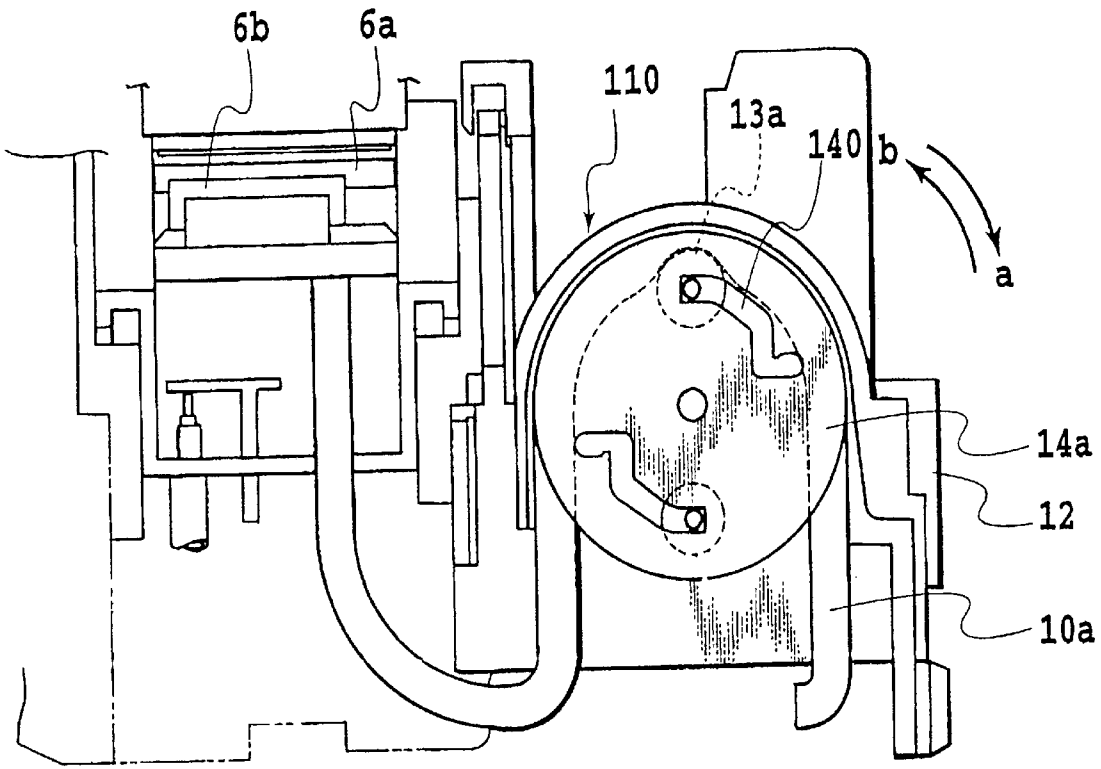
FIG. 20 is a side view of a pumping mechanism portion shown in FIG. 15.
Figure 21:
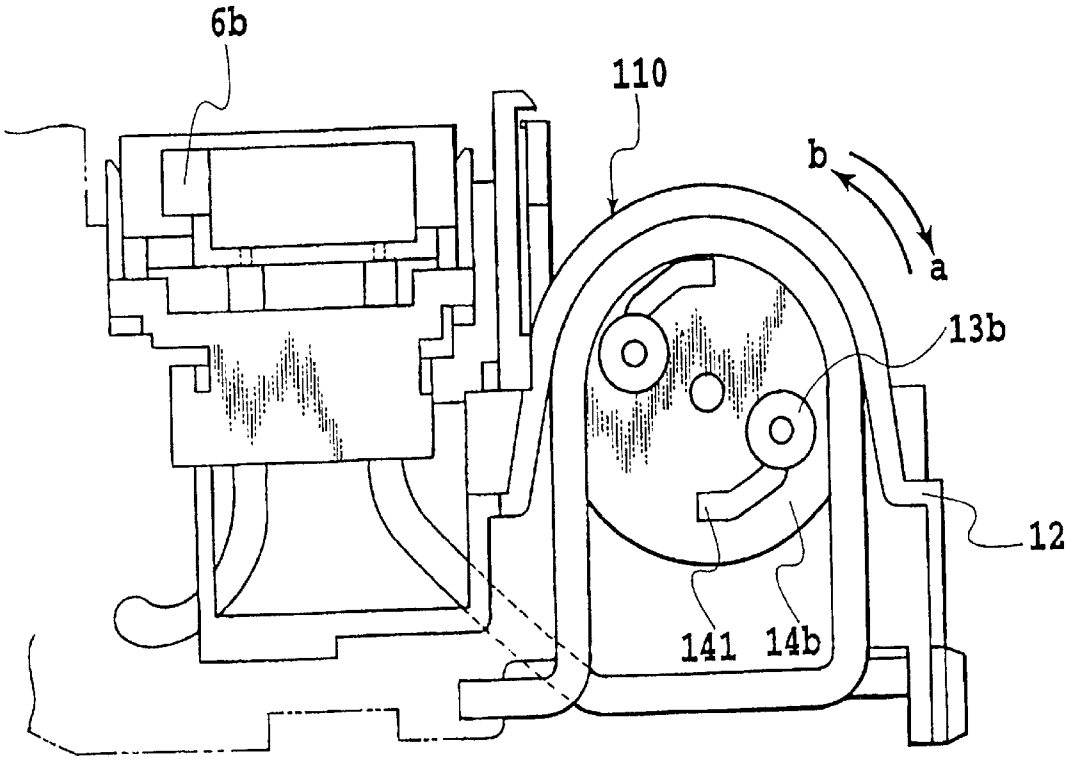
FIG. 21 is a side view of the inside of the pumping mechanism portion shown in FIG. 20.
Figure 22:
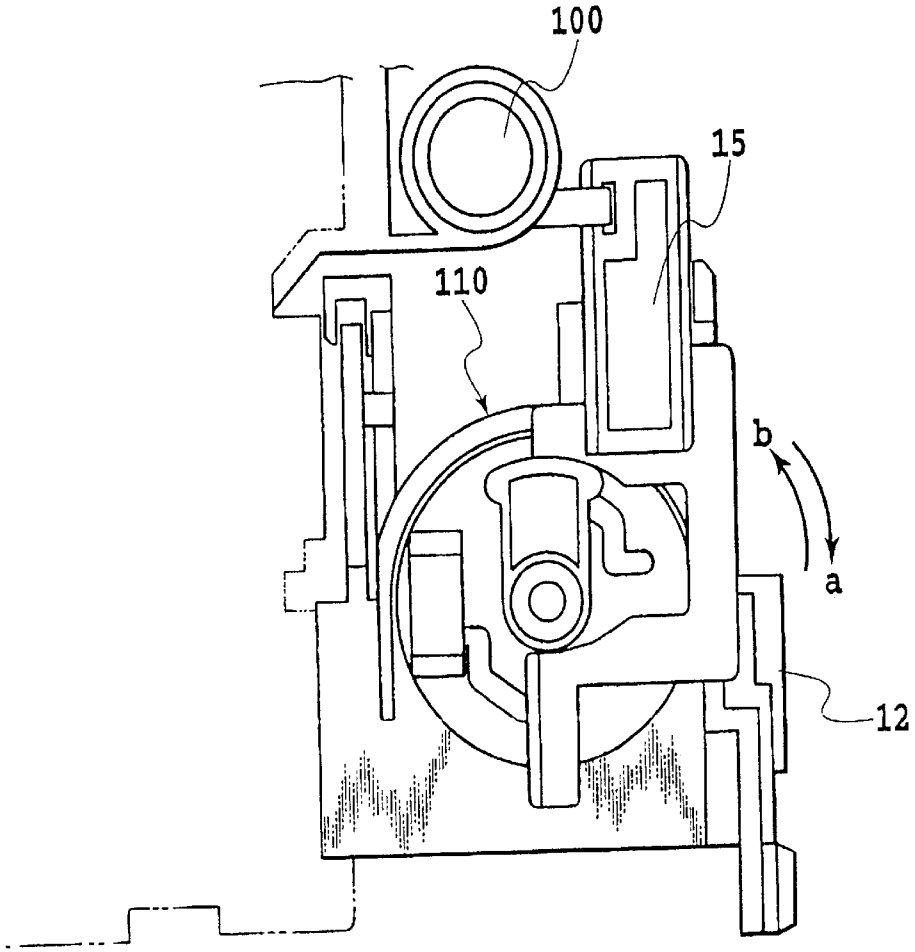
FIG. 22 is a side view of the pumping mechanism portion shown in FIG. 20.

Referring now to FIG. 20, FIG. 21 and FIG. 22, there is shown a configuration of the pump portion as described below.

If a roller holder 14*a* rotates in the direction of the arrow a, as shown in FIG. 20, the suction roller 13*a* moves along a cam 140 of the roller holder 14*a* outwardly in the radial direction and subsequently rotates in conjunction with the roller holder 14*a*. Therefore, the suction roller 13*a* presses the suction tube 10*a* positioned between the recovery base 12 and the suction roller 13*a* to generate an negative pressure in the cap 6*a*. If the roller holder 14*b* rotates in the direction of the arrow a as shown in FIG. 21 in conjunction with the roller holder 14*a*, the suction roller 13*b* moves along a cam 141 of the roller holder 14*b* inwardly in the radial direction and subsequently rotates in conjunction with the roller holder 14*b* at the position where the suction tube 10*b* is not pressed. Therefore, the inside of the cap 6*b* communicating with the suction tube 10*b* becomes open into the air.

If the roller holder 14*b* rotates in the direction of the arrow b, oppositely, the suction roller 13*b* moves along a cam 141 of the roller holder 14*b* outwardly in the radial direction and subsequently rotates in conjunction with the roller holder 14*b*. Therefore, the suction roller 13*b* presses the suction tube 10*b* positioned between the recovery base 12 and the suction roller 13*b* to generate an negative pressure in the cap 6*b*. At this moment, the roller holder 14*a* rotates in the direction of the arrow b in conjunction with the roller holder 14*b*. However, the suction roller 13*a* moves along a cam 140 of the roller holder 14*a* inwardly in the radial direction and subsequently rotates in conjunction with the roller holder 14*a* at the position where the suction tube 10*a* is not pressed. Therefore, the inside of the cap 6*a* communicating with the suction tube 10*a* becomes open into the air.

The carriage lock 15 is subjected to a friction drive so as to be locked at the time of the rotation (i.e., the normal rotation in this embodiment) of the suction pump 110 in the direction of the arrow b and unlocked at the time of the rotation (i.e., the reverse rotation in this example) in the direction of the arrow a thereof.

Next, we will describe configurations of the caps 6*a*, 6*b* and their peripheral portions.

As shown in FIG. 15, the caps 6*a*, 6*b* are held on a cap holder 7 which is retained by a cap slider 8 through a cap spring. In addition, each of the caps 6*a*, 6*b* includes two openings. Each of the caps 6*a*, 6*b* establishes connection with an end of the suction tube 10*a* or 10*b* through its opening and an end of the air-communicating tube through its another opening as in the same way as that of the embodiment described above. The other end of the air-communicating tube is inserted into the cap slider 8, and also a valve 17 (see FIG. 6) is provided on its tip through a packing as in the same way as that of the embodiment described above. The cap slider 8 slides over the valve 17 so as to open or close the valve 17 as a result of pushing the cap slider 8 with a motion of the carriage 2. That is, the valve 17 is in the closed state at the position [2] of FIG. 9, while it is in the opened state at the position [1].

A series of the motion will be described below.

If the power to the printing apparatus is turned on, the suction pump 110 starts to rotate in the right direction (the arrow a direction) by means of a driving source (not shown). As a result, the carriage lock 15 is released from the locked state. After releasing the carriage lock 15, the carriage 2 moves toward the wiper-turning position [7] in FIG. 9.

Figure 16:
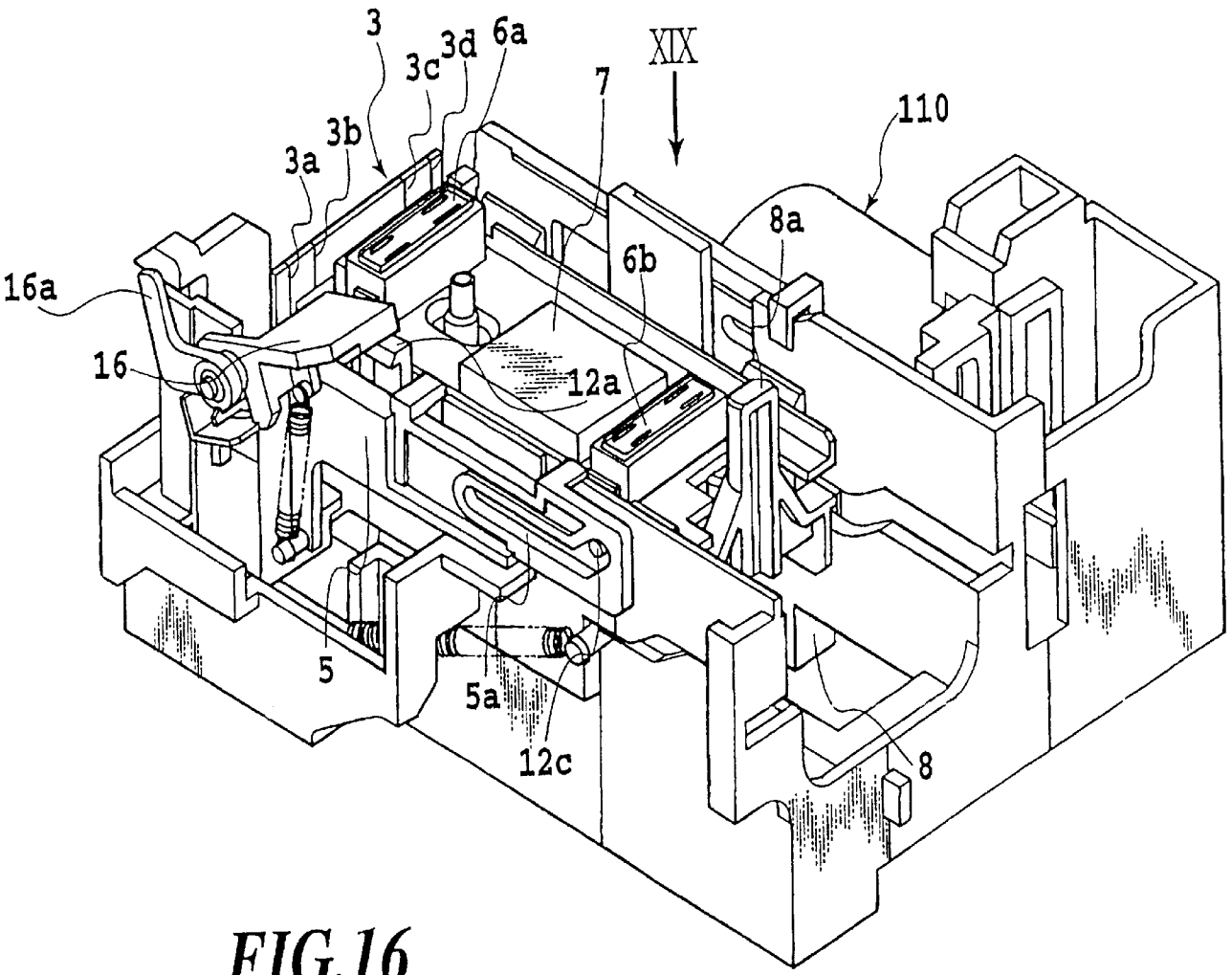
FIG. 16 is a perspective view of a wiper-holder base of FIG. 15 at a descent.
Figure 17:
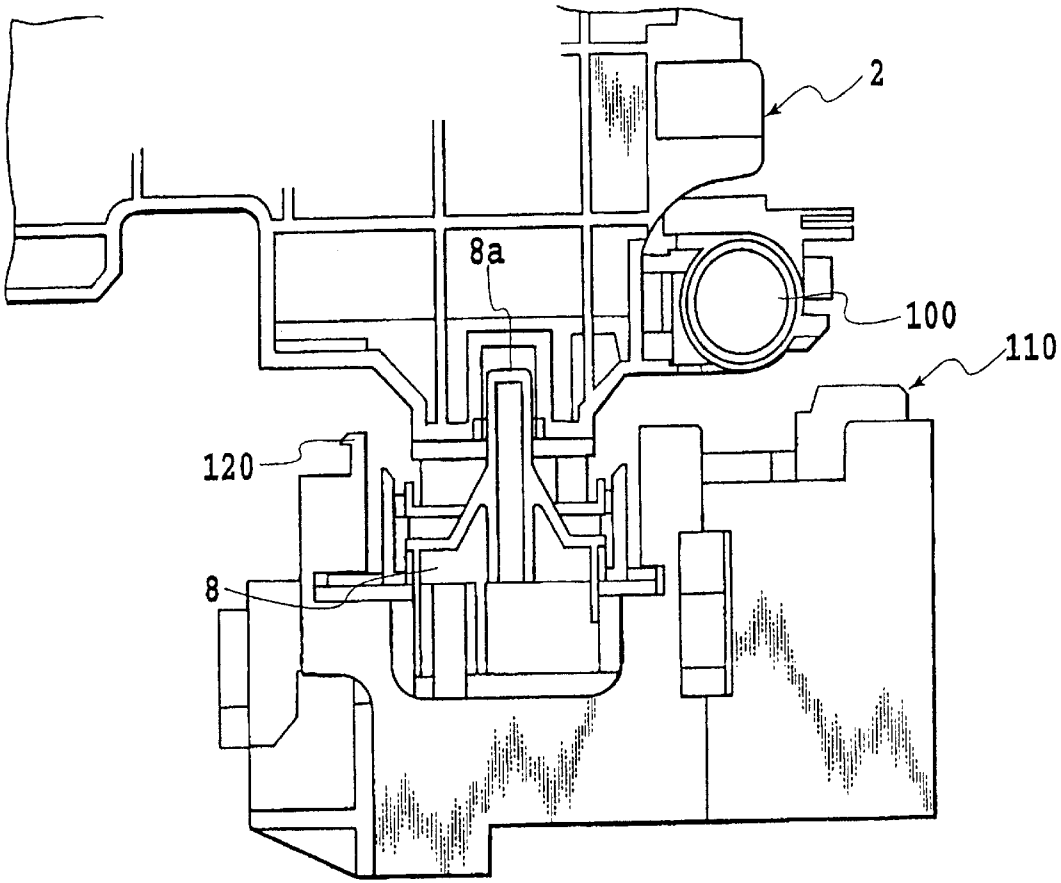
FIG. 17 is a plan view for illustrating the carriage and the wiping mechanism portion taken in the direction shown by the arrow XVII in FIG. 14.

The wiping-start position is established between the cap position [3] and the print-standby position (HP) [6]. During the period of moving the carriage 2 to the record-standby position [6], the cap 6 is opened to perform wiping motion of the wiper 3 on the printing head 111, 112. If the carriage 2 moves to the position [7], a protrusion 2*a* (see FIG. 18) formed on the carriage 2 makes contact with a wiper-lock lever 16*a* to release the engagement between the wiper lock 16 and the hook 12*b* of the recovery base 12. As a result, the wiper 3 moves downwardly from the printing head 111, 112 to the standby position (see FIG. 16). In a state shown in FIG. 16, the wiper 3 cannot make contact with the printing head 111, 112.

If the necessity of wiping arise during the printing motion, the carriage 2 moves from the printing region to the position [4] to engage the wiper lock 16 on the hook 12*b* of the recovering base 12. Therefore, the wiper 3 is kept at the position where it makes contact with the printing head 111, 112. Then, the carriage 2 shifts its position to the position [7] again to perform a wiping movement.

Figure 18:
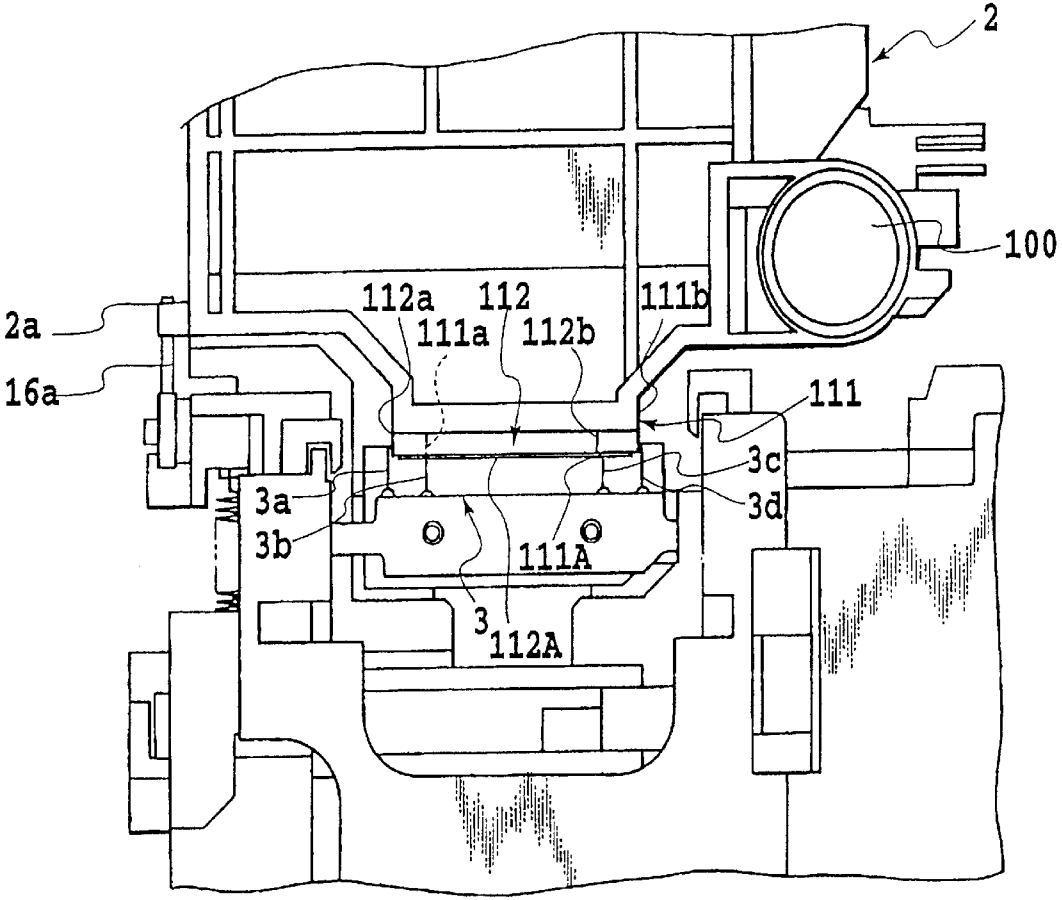
FIG. 18 is an enlarged view of a main portion for illustrating the relationship between the wiper and the printing head shown in FIG. 16.

In the wiper 3, as shown in FIG. 18, there are four wiper slit portions 3*a*, 3*b*, 3*c*, and 3*d*. The slit 3*a* is formed on the position corresponding to the side 112*a* of the head 112, the slit 3*b* is formed on the position corresponding to the side 111*a* of the head 111, the slit 3*c* is formed on the position corresponding to the side 112*b* of the head 112, and the slit 3*d* is formed on the position corresponding to the side 111*b* of the head 111. In this embodiment, the slit portions 3*a*, 3*b*, 3*c*, and 3*d* are formed on the positions facing to the sides 112*a*, 111*a*, 112*b*, and 111*b*, respectively. In addition, each of the slit portions 3*a*, 3*b*, 3*c*, and 3*d* is linearly formed along the predetermined area from a free end (the top) to a fixed end (the bottom) of the wiper 3 in the shape of a sheet.

Therefore, the wiper 3 makes press-contact with the sides 111*a*, 111*b*, 112*a*, and 112*b* in addition to the faces 111A, 112A of the heads 111, 112, concurrently with its movement. That is, an area between the slits 3*b*, 3*d* of the wiper 3 wipes the face 111A (i.e., a surface where orifices are formed) of the head 111. Also, an area between the slits 3*a*, 3*c* of the wiper 3 wipes the face 112A (i.e., a surface where orifices are formed) of the head 112. A left-side portion that forms the slit 3*a* in FIG. 18 performs the wiping behavior (spaced wiping) at a location some distance from the side 112*a* of the head 112. A left-side portion that forms the slit 3*b* in FIG. 18 wipes (sliding-contact wiping) the side 111*a* of the head 111.

A right-side portion that forms the slit 3*c* in FIG. 18 wipes (sliding-contact wiping) the side 112*b* of the head 112. A right-side portion that forms the slit 3*d* in FIG. 18 performs a spaced wiping on the side 111*b* of the head 111. In the present embodiment, there are two types of the wiping behavior in which one is of sliding-contact wiping and the other of spaced wiping. The space wiping is preferable because it takes the load off the printing head.

As described above, the sides 111*a*, 111*b*, 112*a*, and 112*b* of the heads 111, 112 can be wiped in addition to the faces 111A, 112A, so that there is no possibility of remaining any ink deposit on those surfaces. Therefore, there is no possibility of the deposition of viscous ink on the heads 111, 112, so that it becomes possible to perform a print satisfactorily all the time.

Figure 19:
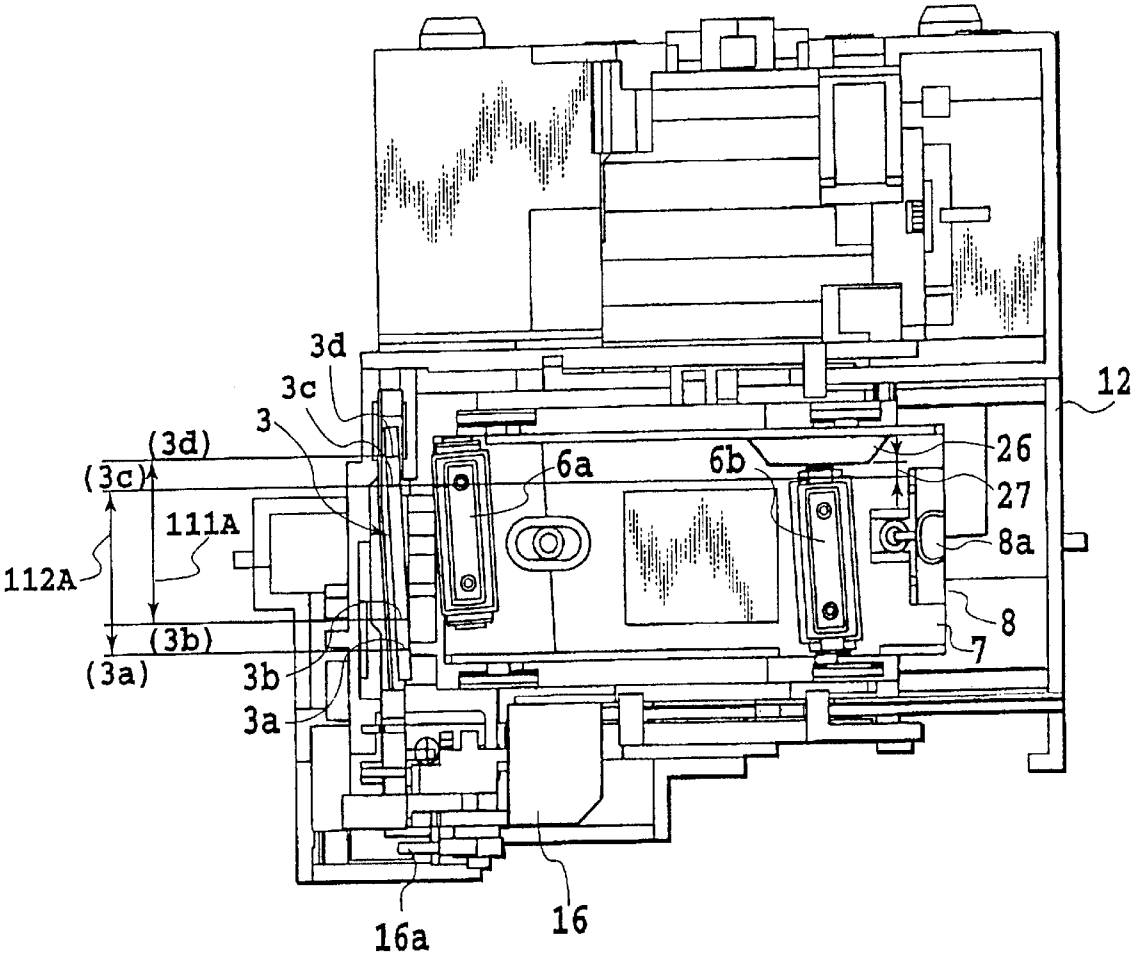
FIG. 19 is a plan view for illustrating the wiper-holder base taken in the direction shown by the arrow XIX in FIG. 16.

In FIG. 19, reference numeral 26 denotes a scraper which is formed on the cap holder 7 and laterally adjacent to the cap 6*b*. The scraper 26 is positioned at a predetermined distance (e.g., 0.7 mm) 27 from the side 111*a* of the printing head 111. The scraper 26 can be functioned as the same way as a scraper 200 in an eighth embodiment described later. Therefore, the scraper 26 moves up and down as the cap holder 7 moves up and down, resulting that the scraper 26 scratches the viscous ink off. In this case, the viscous ink is deposited on the side 111*a* of the printing head 111 and grown to a height corresponding to the distance 27 or over. The side 111*a* of the printing head 111 is positioned on the side 21 of the head H in FIG. 29, i.e., the side of an electrically contact portion 23. It is noted that the scraper 26 is further provided so as to remove the ink deposit on that side 111*a*, so that it prevents the problems to be caused by a deposition of ink on the electric contact portion 23, such as the development of electric short circuit.

Furthermore, the scraper 26 may be used for removing deposits from any sides of the printing heads 111, 112, for example by placing the scraper 26 in the position facing to one of the sides of the printing head 111 except the side 111*a* or the side of the printing head 112.

Additional features, configurations, and effects of the present embodiment can be found in the same as those of the first embodiment described above.

Third Preferred Embodiment

Figure 23:
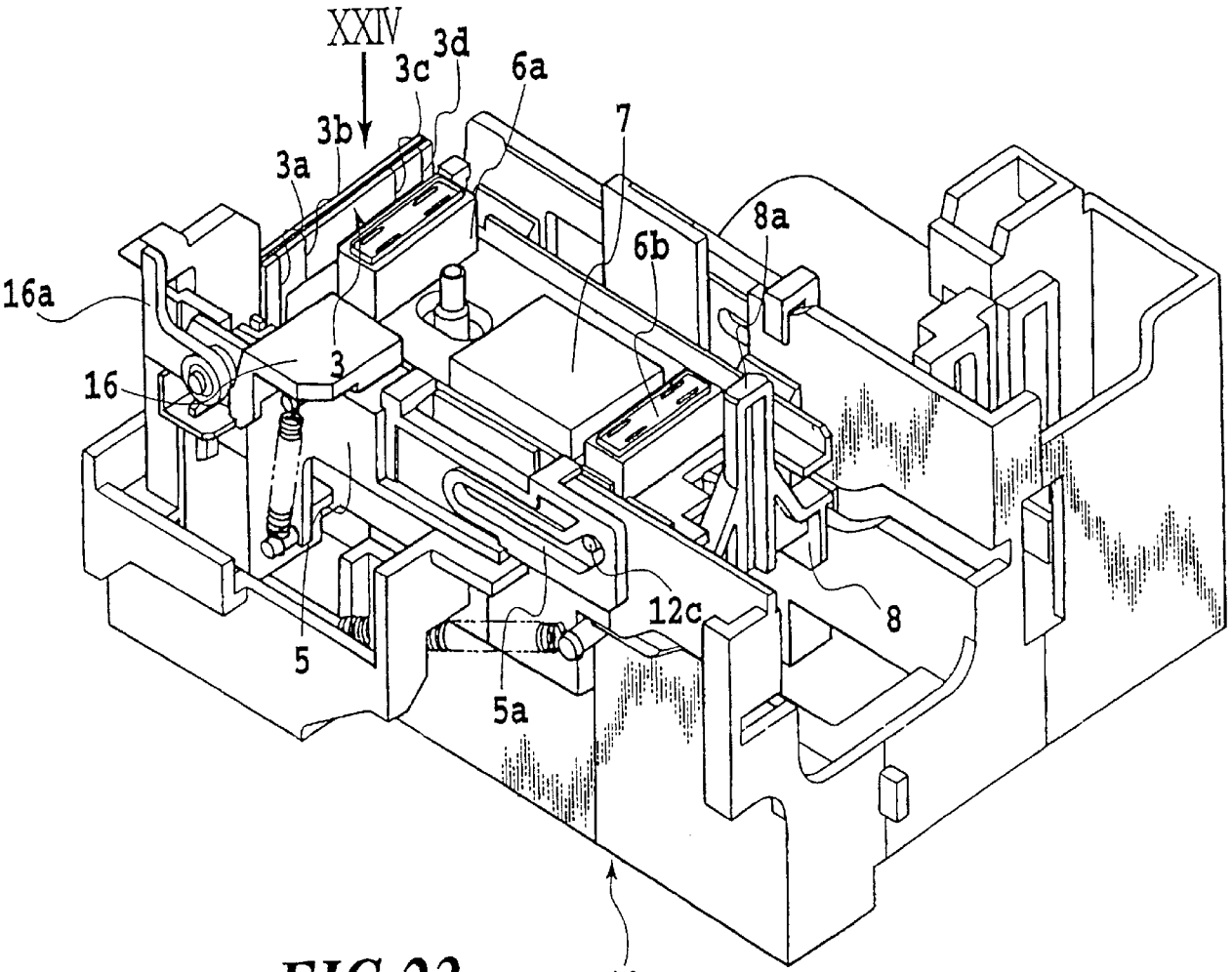
FIG. 23 is a perspective view of a wiping mechanism portion in accordance with a third preferred embodiment of the present invention.
Figure 24:
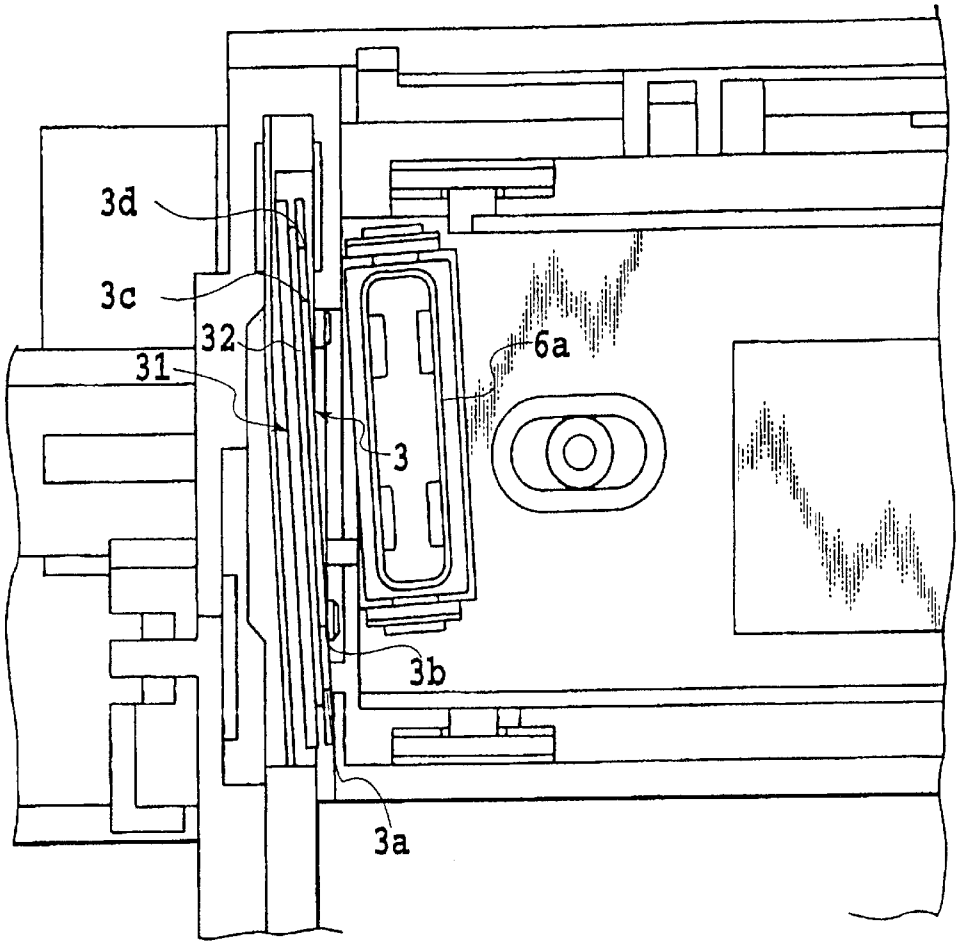
FIG. 24 is a partially enlarged view of the wiping mechanism portion taken in the direction shown by the arrow XXIV in FIG. 23.

FIG. 23 and FIG. 24 illustrate the third preferred embodiment of the present invention.

In this embodiment, a wiper 31 is further provided as an additional wiping means in addition to a wiper 3 as a wiping means. Reference numeral 32 denotes a spacer provided between the wipers 3, 31. Like the second embodiment described above, as shown in FIG. 24, there are four slits 3*a*, 3*b*, 3*c*, and 3*d* formed on the wiper 3. Like the second embodiment described above, furthermore, these slits allow that the wiper 3 wipes the face and the side of the color head 112 and the photo head 111. On the other hand, there is no slit formed on the wiper 31. In this case, edges of the wiper 31 is finished with high accuracy to lessen a residue of the wiping of ink on the faces of the heads 111, 112. Therefore, a finish-wiping can be performed using the wiper 31 downstream from the wiper 3 (i.e., on the left side in FIG. 24).

According the above configuration of the wiping means, the side of each of the heads 111, 112 are wiped using slits of the wiper 3. In addition, the face of each of the heads 111, 112 can be further wiped using the wiper 31 in addition to the wiping motion with the wiper 3. As a result, the wiping can be performed perfectly without remaining any residual deposit, allowing an excellent results of print.

Additional features, configurations, and effects of the present embodiment can be found in the same as those of the first embodiment described above.

Fourth Preferred Embodiment

Figure 25:
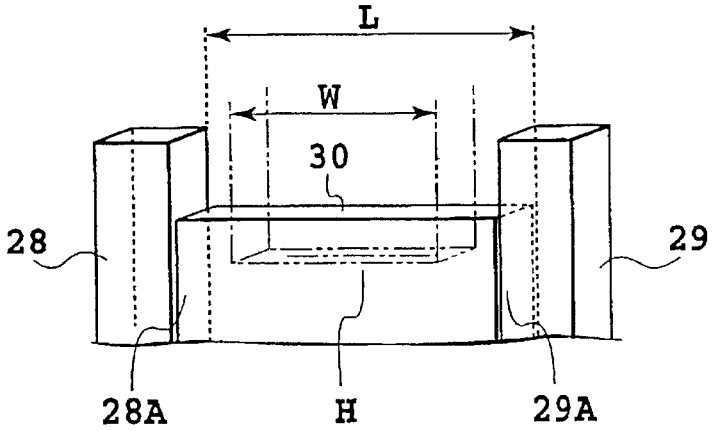
FIG. 25 is a perspective view of a main portion of a cleaning member in accordance with a fourth preferred embodiment of the present invention.

FIG. 25 is a schematic representation of a main portion of a cleaning member in accordance with a fourth preferred embodiment of the present invention.

The cleaning member comprises a wiper 30 for cleaning a printing head H and structural components 28, 29 for removing deposits on the side of the head H (hereinafter, referred as deposit-removing members) Each of the deposit-removing members 28, 29 is provided on the side of the head H and protruded longer than the wiper 30. In the figure, the head H having a width H is represented by a broken line. The deposit-removing members 28, 29 are placed at a predetermined distance from the head H so as to be able to remove a deposit I on the side of the head H. The distance L between two deposit-removing members 28, 29 can be expressed as a relationship with the width W of the head H in an inequality: L>W.

Alternatively, the cleaning member may be constructed by forming deep slits 28A, 29A in a sheet of elastic material. Also, the wiper 30 and the deposit-removing members 28, 29 may be prepared as different components and then assembled as a single component. In this case, the wiper 30 and the deposit-removing members 28, 29 may be constructed using the same material or different materials. For example, the deposit-removing members 28, 29 may be prepared using a metal material, a plastic material, or the like so as to be different from the material of the wiper 30. In addition, the deposit-removing members 28, 29 are separated from each side of the head H at a distance of 1 mm or less. Furthermore, each of the deposit-removing members 28, 29 has a portion facing to the side of the head H which performs the relative movement. The portion facing to the side of the head H may be constructed using an elastic member (metals and plastics are also available because of their elasticities).

The cleaning member of FIG. 25 has deep-grooved slits, so that there may be a warp in the wiper 30 at the time of cleaning the head H. In this case, however, the deposit-removing members 28, 29 are substantially free from such a warped wiper 30. Therefore, it is possible to keep the constant space (1 mm or less) between the deposit-removing members 28, 29 and the side of the head H, so that ink can be smoothly moved from the side thereof.

Figure 29:
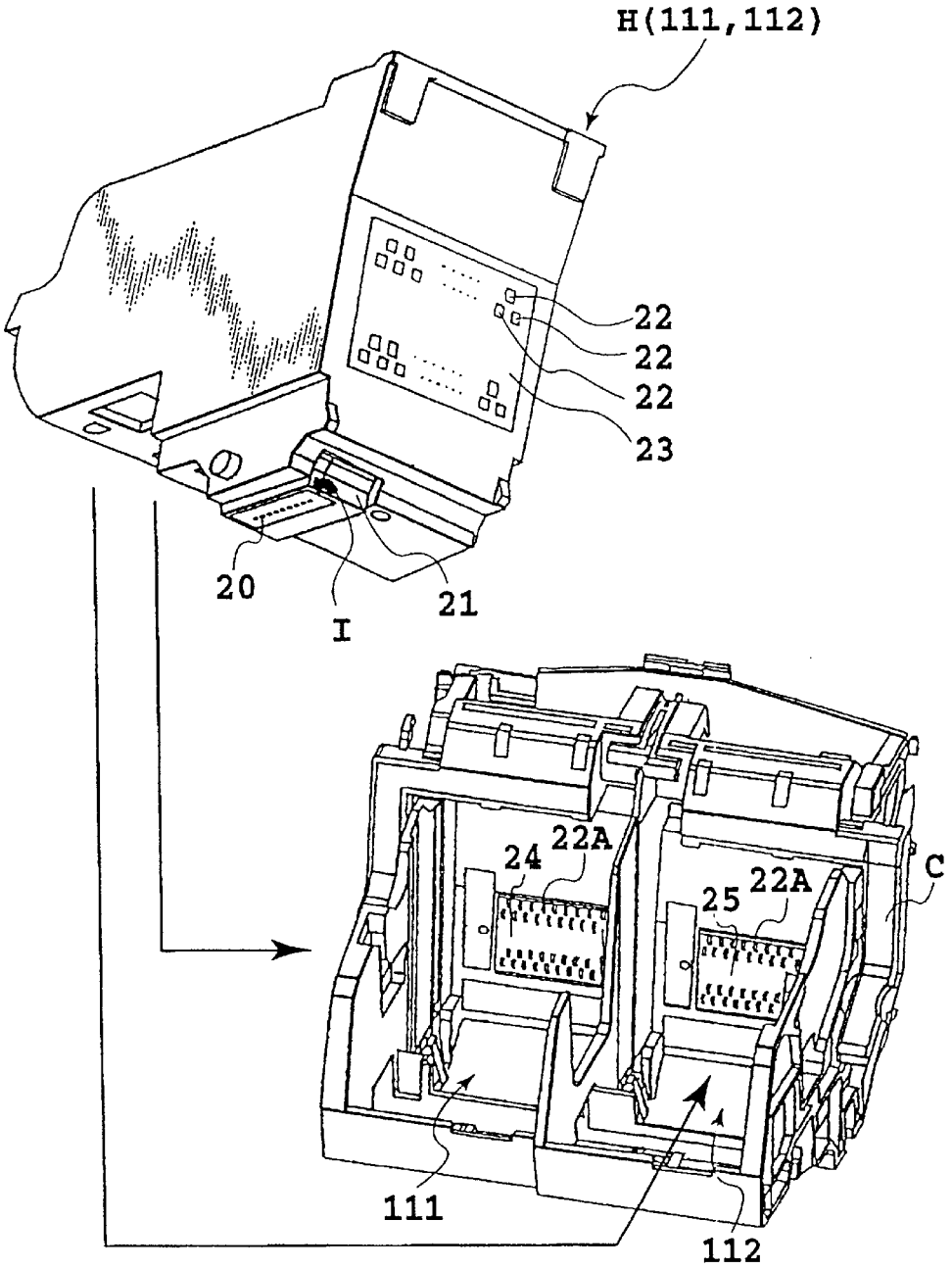
FIG. 29 is a perspective view of a printing head and a carriage for illustrating a problem of accumulating viscous ink on the side of the printing head.
Figure 30:
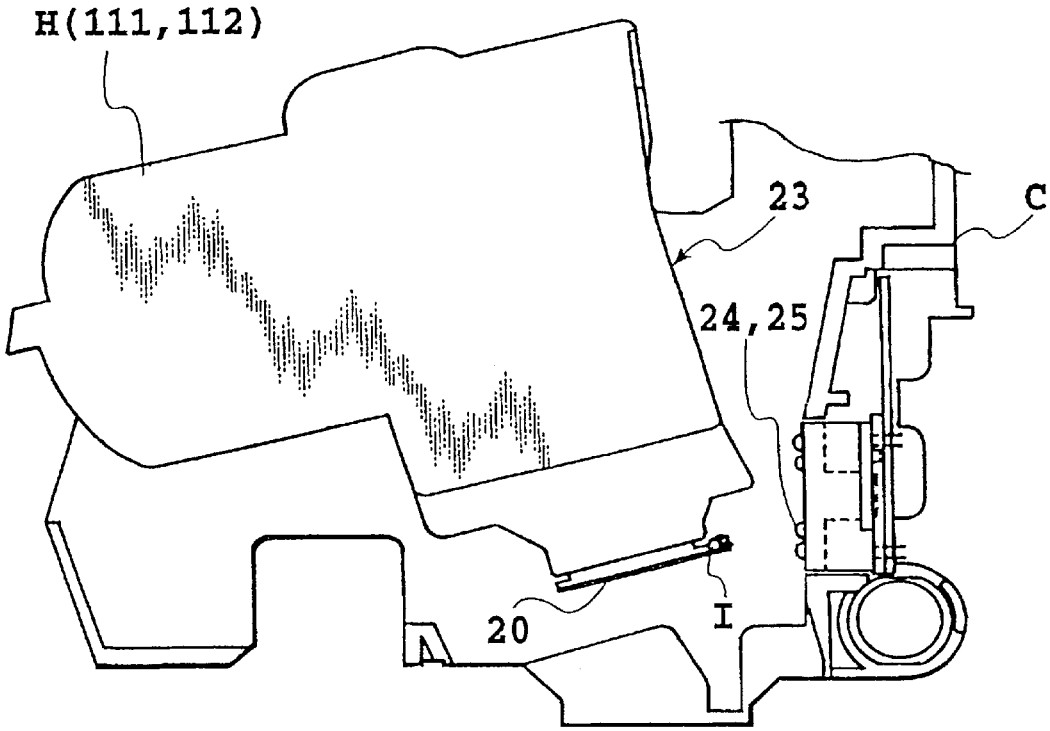
FIG. 30 is a side view of a main portion of the printing head and the carriage for illustrating a problem of accumulating viscous ink on the side of the printing head.

As shown in FIG. 29 and FIG. 30, an ink deposit I being adhered on the side of the head H will be grown up to an deposition height of about 1–2 mm if it is untouched. However, the deposit-removing members 28, 29 are able to move closer to the side of the head H at a distance of 1 mm or less, so that ink can be removed by moving toward a lower part of the cleaning member. That is, it is possible to move ink toward the deposit-removing members 28, 29 and draw ink into their slits.

Fifth Preferred Embodiment

Figure 26A:
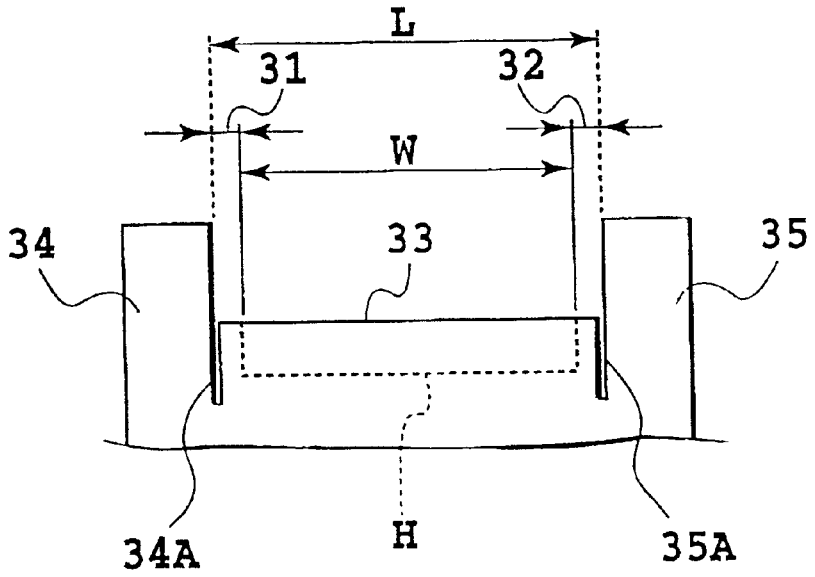
FIG. 26A is a front view of a main portion of a cleaning member in accordance with a fifth preferred embodiment of the present invention.
Figure 26B:
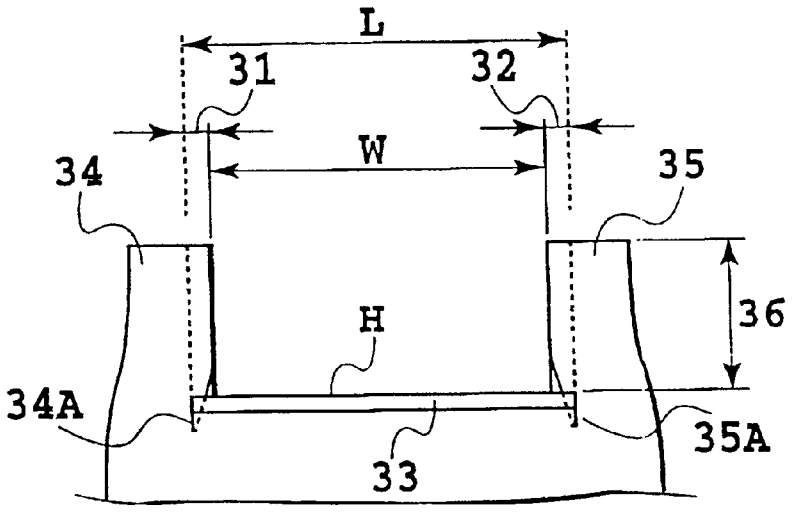
FIG. 26B is a front view of the main portion of the cleaning member in accordance with a fifth preferred embodiment of the present invention.

FIG. 26A and FIG. 26B are schematic representations for illustrating a main portion of a cleaning member in accordance with a fifth preferred embodiment of the present invention.

In this embodiment, each of slits 34A, 35A is formed on the cleaning member at a relatively shallow depth compared with the slits 28A, 29A of FIG. 25. In this embodiment, furthermore, the deposit-removing members 34, 35 create clearances 31, 32 from the side of the head H.

If the head H is cleaned by the cleaning member of the present embodiment, each of the deposit-removing members 34, 35 is inwardly inclined as the wiper 33 becomes elastically deformed at the time of contacting with an orifice surface of the head H. Therefore, the tips of the deposit-removing members 34, 35 make contact with their corresponding sides of the head H and then slide over these sides, resulting in the elimination of ink from the sides of the head. By the way, a base portion of each of the deposit-removing members 34, 35 is kept from contact with the side of the head H. Comparing with the configuration of FIG. 25, however, the deposit-removing members 34, 35 are able to take their positions closer to the sides of the head H.

In FIG. 26A and FIG. 26B, as described above, the deposit-removing members 34, 35 make contact with their respective sides of the head H and slide thereover as a result of their bendings through the use of a warp in the wiper 30 at the time cleaning the orifice surface of the head H. Thus, it is preferable to narrow the clearances 31, 32 as much as possible. For defining the dimensions of the clearances 31, 32, a good deal of thought may be given to tolerances of mounting the cleaning member and the head, or the like. The configuration for contact-sliding the deposit-removing members 34, 35 over the sides of the head H provides excessive load on the head H. As shown in FIG. 11, for example, it is preferable to remove ink deposits on the sides of the head by the above members 34, 35 under the condition of keeping the members 34, 35 from contact with the sides of the head.

Sixth Preferred Embodiment

Figure 27:
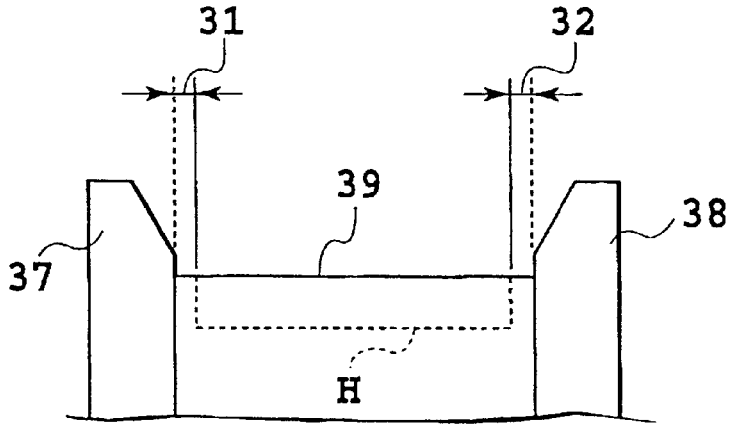
FIG. 27 is a front view of a main portion of a cleaning member in accordance with a sixth preferred embodiment of the present invention.

FIG. 27 is a schematic representation of another configuration of the cleaning member.

In the cleaning member of the present embodiment, deposit-removing members 37, 38 are constructed so that their tips (i.e., portions of the deposit-removing members 28, 29 facing to the corresponding sides of the head as shown in FIG. 25) are partially cut away to make notches for the purpose of allowing a deviation from the positioning accuracy at the time of mounting the head H. Thus, it is preferable that such notches are formed on the deposit-removing members.

Seventh Preferred Embodiment

Figure 28:
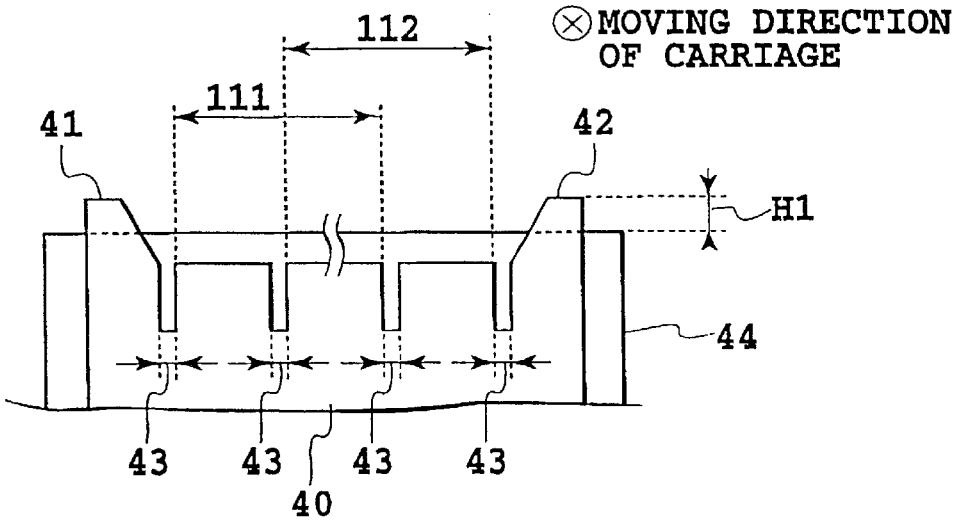
FIG. 28 is a front view of a main portion of a cleaning member in accordance with an seventh preferred embodiment of the present invention.

FIG. 28 is a schematic representation of a cleaning member to be used in a printing apparatus using more than one printing heads such as one shown in FIG. 23 and FIG. 24.

In this embodiment, a cleaning member comprises two wipers 40, 44 and deposit-removing members 41, 42. Therefore, an orifice surface of each of the heads 111, 112 is cleaned by a wiper 40 at first and then further cleaned by another wiper 44. The deposit-removing members 41, 42 are responsible for cleaning lateral faces of the head and provided on both sides of the wiper 40. In addition, there are slits 43 formed on the wiper 40 and the deposit-removing members 41, 42. Each of the slits 43 has a width of about 0.5 mm.

The orifice surface of the head 111 is cleaned by the wiper 40 except the most right side portion thereof in the figure. The deposit-removing member 41 and the side of the most right side portion of the wiper 40 are in the state of non-contact with the side of the head 111. The orifice surface of the head 112 is cleaned by the wiper 40 except the most left side portion thereof in the figure. The deposit-removing member 42 and the side of the most left side portion of the wiper 40 are in the state of non-contact with the side of the head 112. These non-contact portions for the sides of the heads 111, 112 are able to remove ink from the sides of the heads 111, 112.

An orifice surface of each of the heads 111, 112 is cleaned by a wiper 40 at first and then further cleaned by another wiper 44. The wiper 40 is positioned at the back side of the figure with respect to the deposit-removing members 41, 42. The wiper 44 is protruded over an end face of the wiper 40 to the head side as indicated by H1 in the figure to form a step between the wipers 40, 44, resulting in a more reliable cleaning of the orifice surface of the head. "H1" can be defined in the range of plus 0.1 mm to minus 0.5 mm with respect to the height of the wiper 40. It would be better that the range of "H1" is defined so as to insure that the wiper 40 which is initially fall down by making contact with the head does not exert any influence upon the wiper 43.

Eighth Preferred Embodiment

FIG. 31 to FIG. 34 illustrate the eight preferred embodiment in which a scraper 200 is provided for performing a wiping operation on the side of the head 112 without making contact with each other.

The scraper 200 will be described bellow.

Figure 31:
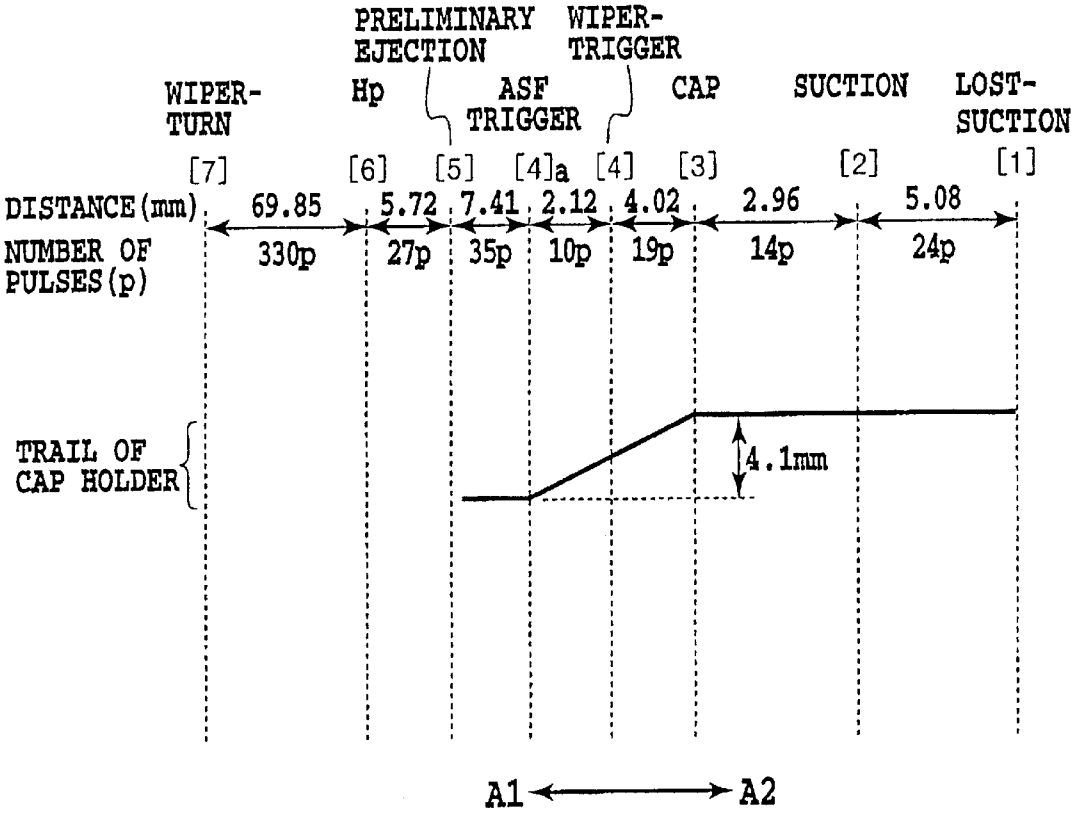
FIG. 31 is a graphical representation for illustrating a recovering operation in the printing apparatus in accordance with the eighth preferred embodiment of the present invention.

A solid line in FIG. 31 represents a trail of a cap holder 7. If the carriage is located at the right-hand (the arrow A2 direction) of the capping position [3], the location of the cap holder 7 is 4.1 mm higher than the normal in the vertical direction and thus faces of the printing heads 111, 112 are hermetically sealed with caps 6*a*, 6*b*, respectively.

Figure 32:
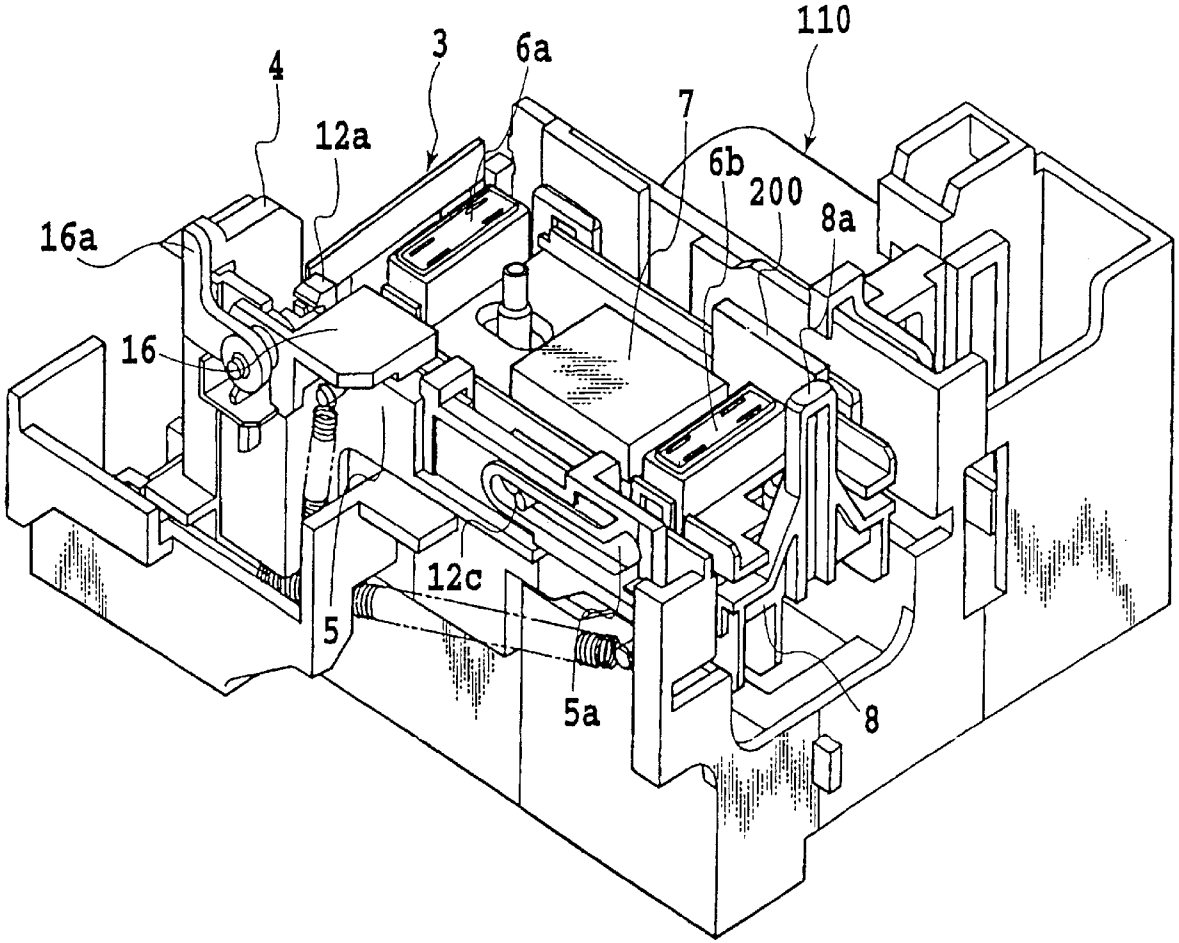
FIG. 32 is a perspective view of a main portion of the printing apparatus in accordance with the eighth preferred embodiment of the present invention.
Figure 33:
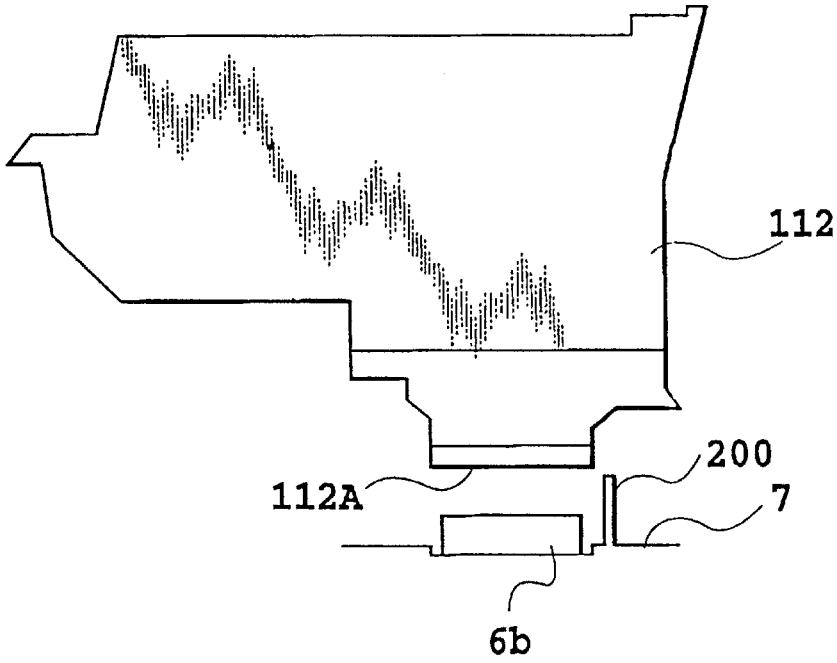
FIG. 33 is a side view for illustrating a scraper in a state of moving downward in relation to the configuration shown in FIG. 32.
Figure 34:
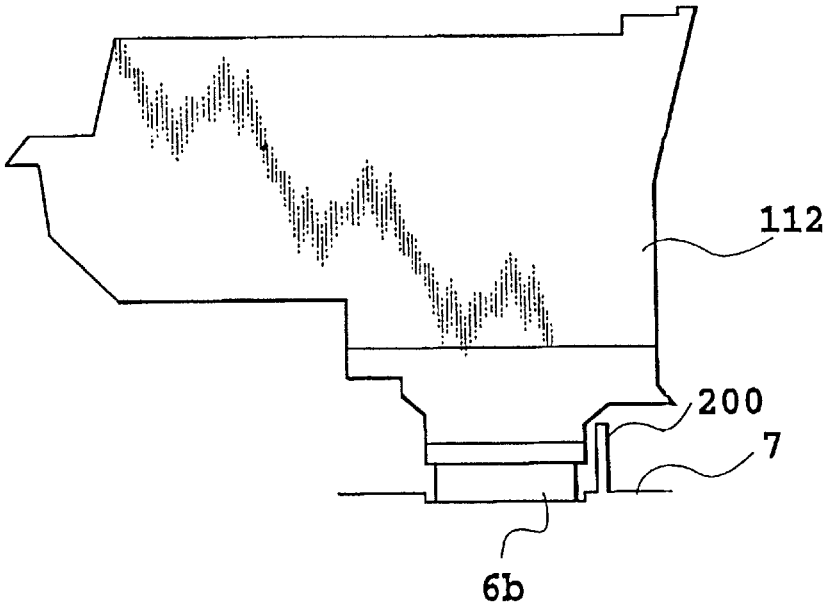
FIG. 34 is a side view for illustrating the scraper in a state of moving upward in relation to the configuration shown in FIG. 32.

In this embodiment, as shown in FIG. 32, the scraper 200 is integral with the cap holder 7 and provided in the lateral direction of the cap 6*b*. The scraper 200 is separated from the side of the printing head 112 at a distance of 0.7 mm. In spite of moving the carriage 2 toward the directions of the arrows A1, A2, the scraper 200 does not contact with the side of the printing head 112. If the carriage 2 moves to the cap position [3], the suction position [2], and a lost-suction position [1], as shown in FIG. 34, the cap holder 7 moves upward in the vertical direction and also the scraper 200 moves upward. As a result, the scraper 200 is protruded to the position facing to the head. As shown in the figure, there is a space between the side of the printing head and the scraper 200 at a distance of 0.7 mm. If the carriage 2 is in the other positions or under the printing operation, the scraper 200 moves downward as the cap holder 7 moves downward as shown in FIG. 33 and FIG. 34.

Accordingly, when capping, suction, or lost-suction operation for the head 112 is performed, the scraper 200 performs the wiping operation on the side of the head 112 without making contact with each other. The scraper 200 scrapes any excess of a viscous ink deposit from the side of the head 112 when the deposit is grown to a size larger than a clearance between the side of the head 112 and the scraper 200. As a result, the accumulation of viscous ink on the side of the printing head 112 does not across the predetermined level, so that an excellent record such as printing can be allowed all the time.

An alternative scraper may be prepared using an elastic material without integral with the cap holder 7 and placed in the same position as that of the first scraper 200 described above.

The scraper 200 and the printing head 112 may shift their positions in a relative manner at the time of capping operation. It is also possible to shift the printing head 112 against the scraper 200. Therefore, the present invention does not limit the mechanism for the relative movement between the scraper 200 and the printing head 112, the direction of such a relative movement, and the like. In the above description, the scraper 200 is ready for the printing head in a one-to-one relationship. However, it is not limited to such a configuration. It is also possible to provide a scraper so as to be ready for more than one printing heads or all of the printing heads to be mounted on the printing apparatus together. It is also possible to provide scrapers on both sides of the printing head to simultaneously scrape ink deposits off.

The present embodiment may be also applied on a printing apparatus having an additional head having the same configuration as those of the printing head 111 or 112 for ejecting a treatment liquid which is responsible for insolublizing or coagulating a color material in ink. An ink deposit on the side of a face (a surface on which orifices are formed for ejecting the treatment solution) may be scraped off by the scraper.

Ninth Preferred Embodiment

Figure 35:
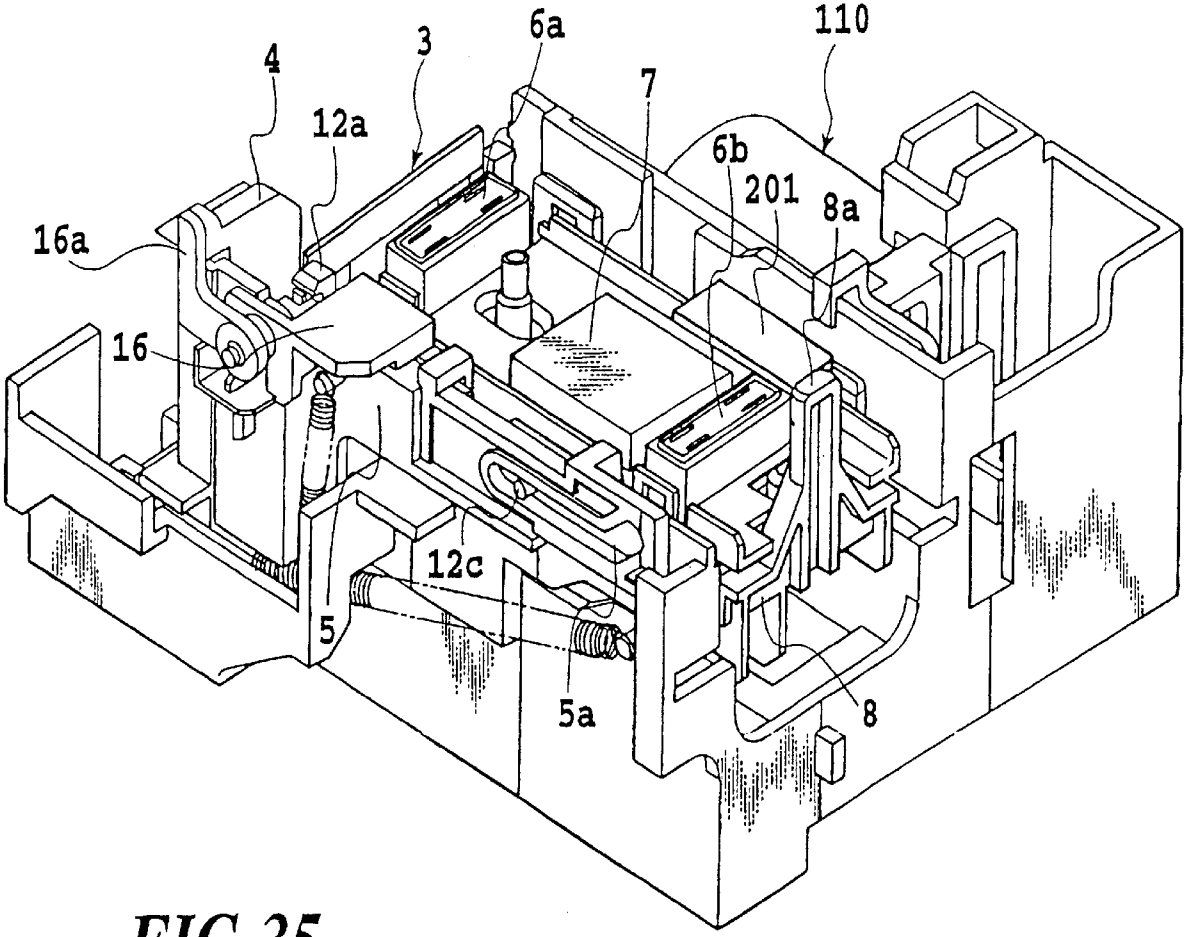
FIG. 35 is a perspective view of a main portion of the printing apparatus in accordance with a ninth embodiment of the present invention.
Figure 36:
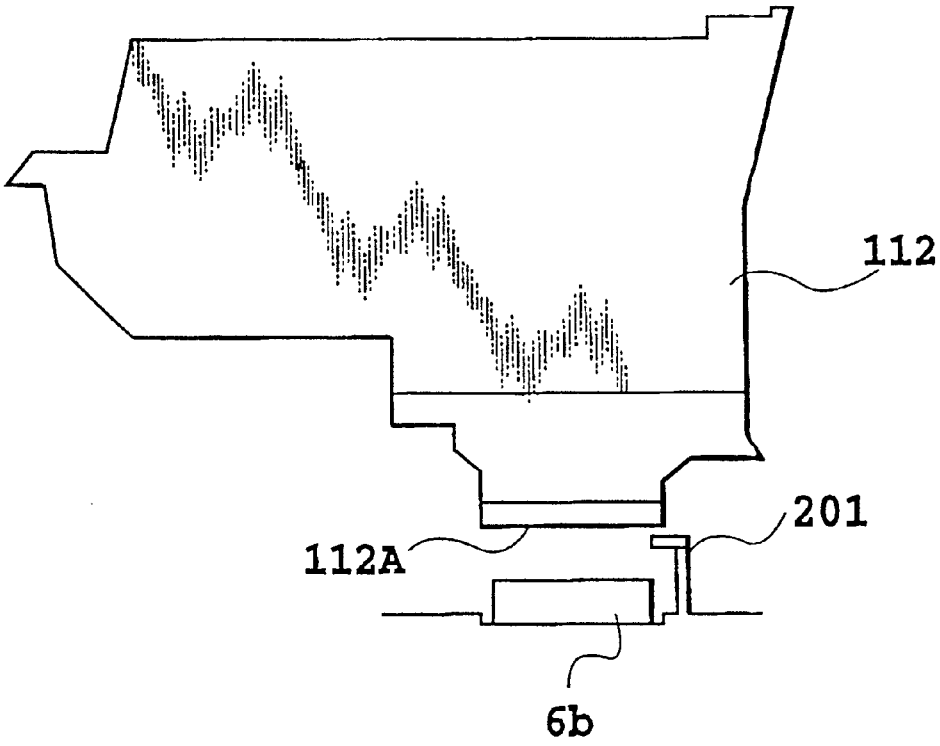
FIG. 36 is a side view for illustrating a scraper in a state of moving downward in relation to the configuration shown in FIG. 35.
Figure 37:
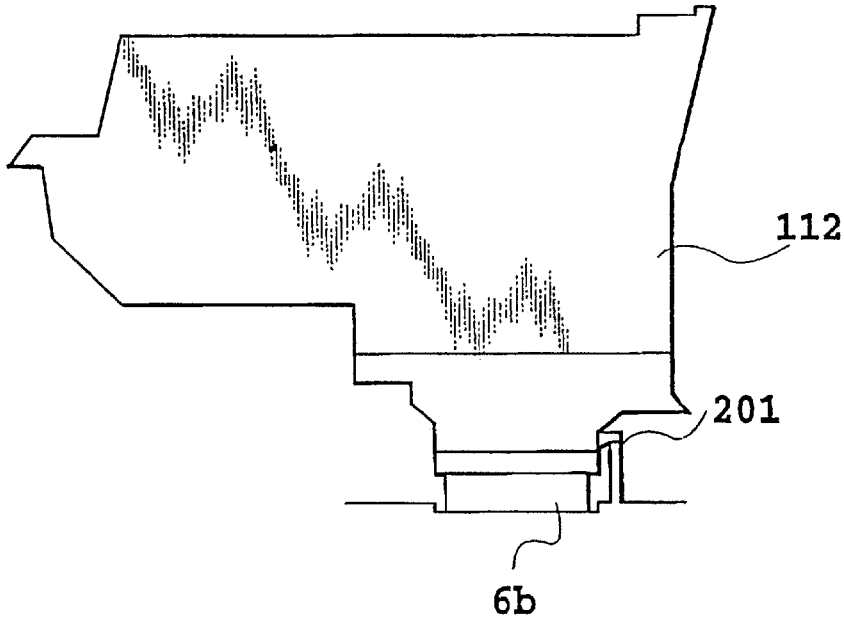
FIG. 37 is a side view for illustrating the scraper in a state of moving upward in relation to the configuration shown in FIG. 35.

FIG. 35 to FIG. 37 illustrate the ninth preferred embodiment in which an elastic scraper 201 is provided. The elastic scraper 201 is located at the position facing to the side of the head 112 and protruded thereto.

If the carriage 2 moves to the capping position [3], the suction position [2], and the lost-suction position [1], as shown in FIG. 37, the scraper 201 moves upward as the cap holder 7 moves upward in the vertical direction. Therefore, the scraper 201 slide on the side of the printing head 112. If the carriage 2 is in the other positions or under the printing operation, the scraper 201 moves downward as the cap holder 7 moves downward as shown in FIG. 36 and FIG. 37.

Accordingly, the scraper 201 makes contact with the side of the head 112 and slides over to remove an ink deposit therefrom. As a result, the accumulation of viscous ink on the side of the printing head 112 can be prevented, so that an excellent print can be allowed all the time.

The scraper 201 and the printing head 112 may shift their positions in a relative manner at the time of capping operation. It is also possible to shift the printing head 112 against the scraper 201. Therefore, the present invention does not limit the mechanism for the relative movement between the scraper 201 and the printing head 112, the direction of such a relative movement, and the like.

In the above description, the scraper 201 is ready for the printing head 112 in a one-to-one relationship. However, it is not limited to such a configuration. It is also possible to provide a scraper so as to be ready for more than one printing heads or all of the printing heads mounted on the printing apparatus together. It is also possible to provide scrapers on both sides of the printing head to simultaneously scrape ink deposits off.

The present embodiment may be also applied on a printing apparatus having an additional head having the same configuration as those of the printing head 111 or 112 for ejecting a treatment liquid which is responsible for insolublizing or coagulating a color material in ink. An ink deposit on the side of a face (a surface on which orifices are formed for ejecting the treatment solution) may be scraped off by the scraper.

Tenth Preferred Embodiment

Figure 38:
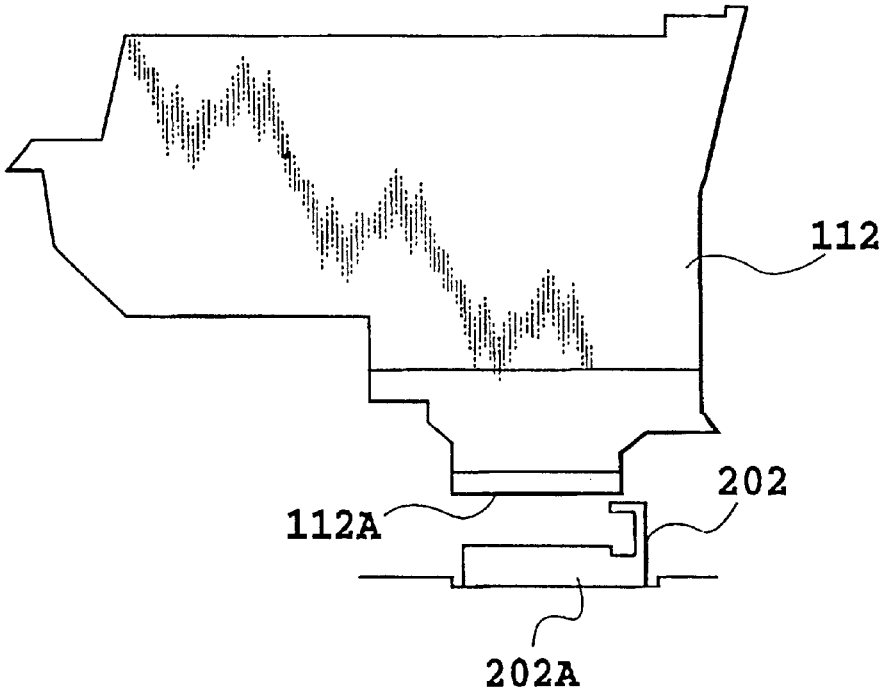
FIG. 38 is a side view for illustrating a scraper in a state of moving downward in accordance with a tenth embodiment of the present invention.
Figure 39:
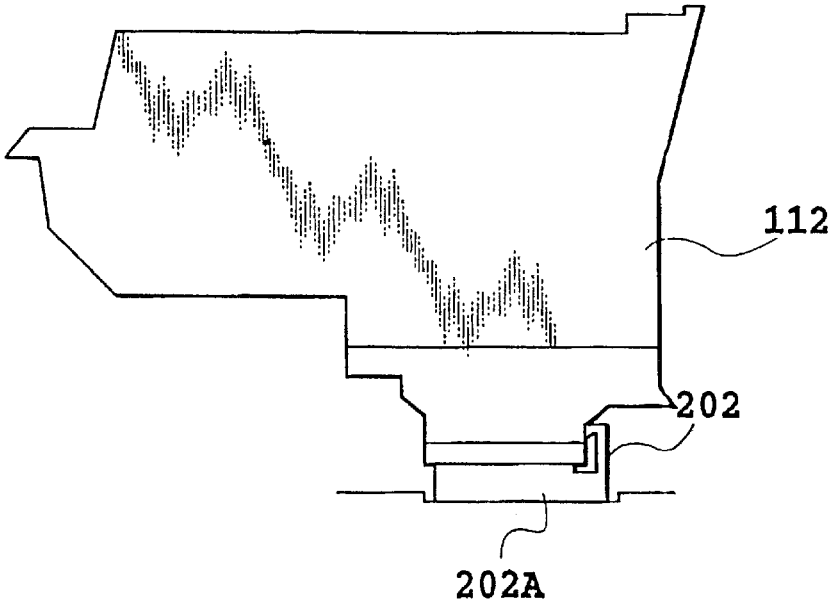
FIG. 39 is a side view for illustrating the scraper shown in FIG. 38 in a state of moving upward.

FIG. 38 and FIG. 39 illustrate the tenth preferred embodiment of the present invention where an elastic scraper 202 is provided.

The elastic scraper 202 is molded in one piece with a cap using an elastic material such as rubber and includes the capability of capping. The scraper 202 is located at the position facing to the side of the head 112 and protruded thereto just as in the case of the ninth preferred embodiment as shown in FIG. 38 and FIG. 39. The other components of the present embodiment are similarly configured as those of the eighth and ninth preferred embodiments.

In the above description, the scraper 202 is ready for the printing head 112. However, it is not limited to such a configuration. It is also possible to provide a scraper 202 so as to be ready for more than one printing heads or all of the printing heads to be mounted on the printing apparatus together. It is also possible to provide scrapers on both sides of the printing head to simultaneously scrape ink deposits off.

FIG. 39 shows the conditions of the carriage 2 moving to the capping position [3], the suction position [2], and the lost-suction position [1]. In these conditions, the scraper 202 integral with the cap portion 202A makes contact with the side of the head 112 and slides over to remove an ink deposit therefrom. If the carriage 2 is in the other positions or under the printing operation, the scraper 202 integral with the cap portion 202A moves downward as shown in FIG. 38.

The scraper 202 and the printing head 112 may shift their positions in a relative manner at the time of capping operation. It is also possible to shift the printing head 112 against the scraper 202. Therefore, the present invention does not limit the mechanism for the relative movement between the scraper 202 and the printing head 112, the direction of such a relative movement, and the like.

The present embodiment may be also applied on a printing apparatus having an additional head having the same configuration as those of the printing head 111 or 112 for ejecting a treatment liquid which is responsible for insolublizing or coagulating a color material in ink. An ink deposit on the side of a face (a surface on which orifices are formed for ejecting the treatment solution) may be scraped off by the scraper.

Eleventh Preferred Embodiment

Figure 40:
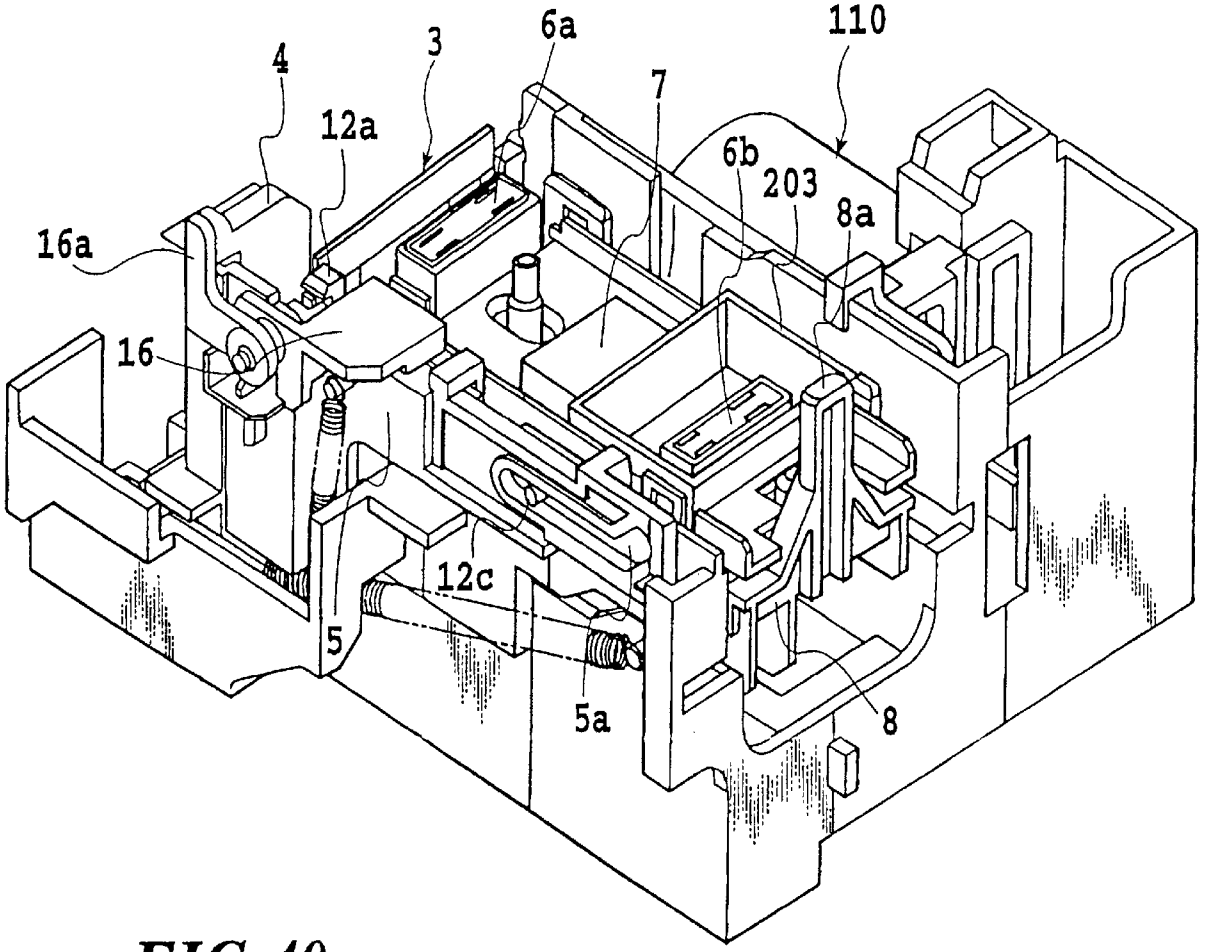
FIG. 40 is a perspective view of a main portion of the printing apparatus in accordance with an eleventh preferred embodiment of the present invention.
Figure 41:
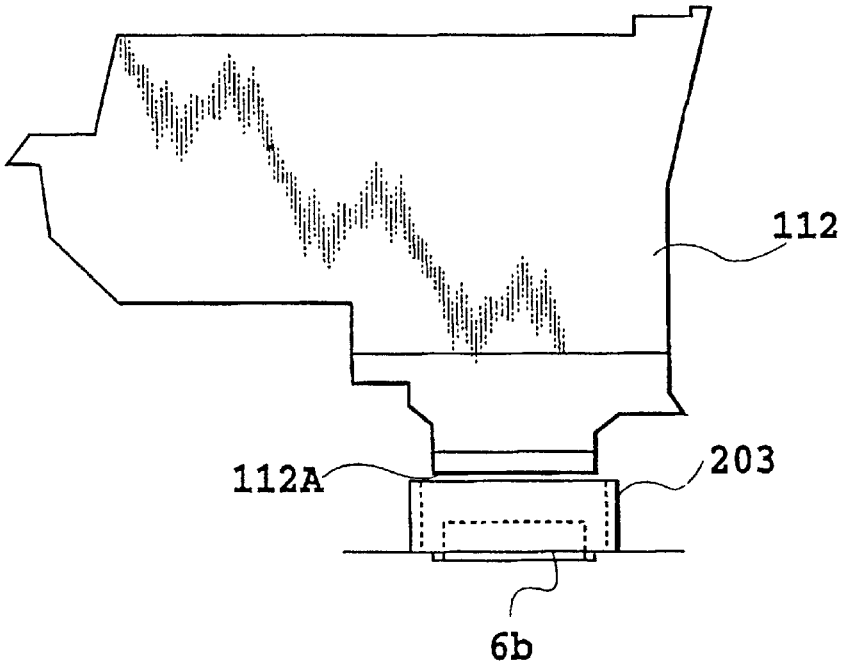
FIG. 41 is a side view for illustrating a scraper in a state of moving downward in relation to the configuration shown in FIG. 40.
Figure 42:
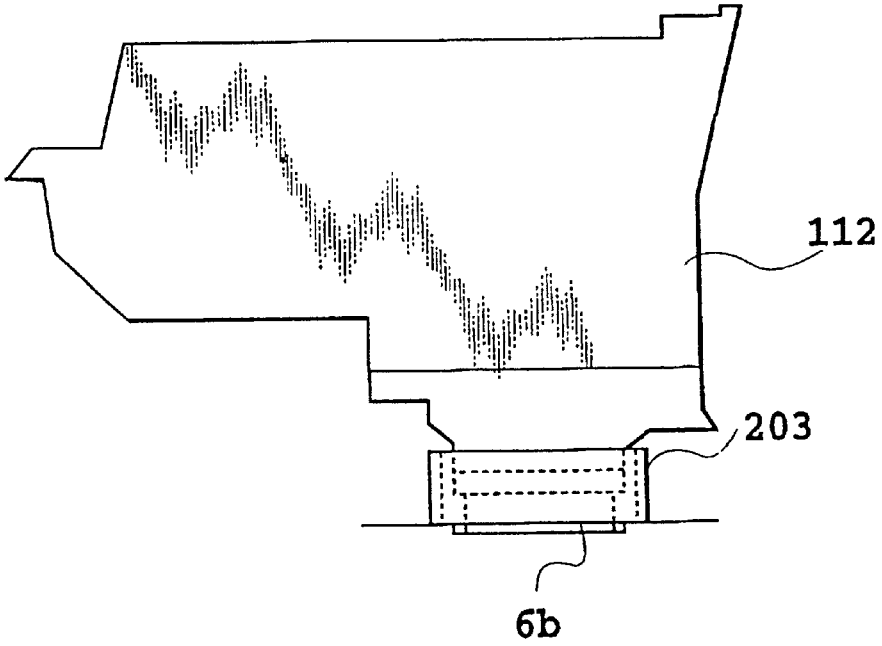
FIG. 42 is a side view for illustrating the scraper in a state of moving upward in relation to the configuration shown in FIG. 40.

FIG. 40 to FIG. 42 illustrate the eleventh preferred embodiment of the present invention, in which a scraper 203 is arranged so as to be ready for a side portion located around a face 112A. In this case, the scraper 203 is configured so as to surround the all ride portions of the head 112, as shown in FIG. 40.

If the carriage 2 moves to the capping position [3], the suction position [2], and the lost-suction position [1], as shown in FIG. 42, the scraper 203 moves upward as the cap holder 7 moves upward in the vertical direction. As a result, the scraper 203 protrudes to the positions facing to all sides of the head. If the carriage 2 is in the other positions or under the printing operation, as shown in FIG. 41, the scraper 203 moves downward as the cap holder 7 moves downward.

Accordingly, the scraper 203 makes contact with the side of the head 112 and slides over to remove an ink deposit therefrom. As a result, the accumulation of viscous ink on the side of the printing head 112 can be prevented, so that an excellent print can be allowed all the time.

In the above description, the scraper 203 is ready for the printing head 112 in a one-to-one relationship. However, it is not limited to such a configuration. It is also possible to provide a scraper so as to be ready for more than one printing heads or all of the printing heads mounted on the printing apparatus together. The scraper 203 may be ready for all or a part of the sides of the printing head 112.

The scraper 203 may be prepared using an elastic material. Also, the scraper 203 may be located at the position facing to the side of the head 112 and protruded thereto for the purpose of making contact with the side of the printing head 112 and sliding thereover just as in the case of the ninth preferred embodiment. In addition, the elastic scraper 203 is molded in one piece with a cap using an elastic material such as rubber and includes the capability of capping just as in the case of the tenth preferred embodiment.

The scraper 203 and the printing head 112 may shift their positions in a relative manner at the time of capping operation. It is also possible to shift the printing head 112 against the scraper 203. Therefore, the present invention does not limit the mechanism for the relative movement between the scraper 203 and the printing head 112, the direction of such a relative movement, and the like.

The present embodiment may be also applied on a printing apparatus having an additional head having the same configuration as those of the printing head 111 or 112 for ejecting a treatment liquid which is responsible for insolublizing or coagulating a color material in ink. An ink deposit on the side of a face (a surface on which orifices are formed for electing the treatment solution) may be scraped off by the scraper.

The other components of the present embodiment are similarly configured as those of the eighth and ninth preferred embodiments.

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers. disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

The present invention can be also applied to a so-called full-line type printing head whose length equals the maximum length across a printing medium. Such a printing head may consists of a plurality of printing heads combined together, or one integrally arranged printing head.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A cleaning device for an ink-jet printing head having an ink-ejecting surface where a plurality of ink-ejecting ports is formed for ejecting ink, in which the ink-ejecting surface is cleaned by a relative movement between the printing head and the cleaning device, the cleaning device comprising:

a deposit-removing member facing to a side of the printing head, wherein the side of the printing head extends substantially in the direction along a relative movement between the printing head and the cleaning device, is positioned along an edge of the ink-ejecting surface, and extends in the direction of crossing the ink-ejecting surface, and wherein the deposit-removing member is fixed on a cap unit that moves and displaces as the printing head moves.

2. A cleaning device for an ink-jet printing head having an ink-ejecting surface where a plurality of ink-ejecting ports is formed for ejecting ink, in which the ink-ejecting surface is cleaned by a relative movement between the printing head and the cleaning device, the cleaning device comprising:

a deposit-removing member facing to a side of the printing head, and an elastic wiping member for wiping the ink-ejection surface of the printing head by means of a relative movement between the elastic wiping member and the printing head, wherein the elastic wiping member is displaceable by itself against the deposit-removing members, wherein the side of the printing head extends substantially in the direction along a relative movement between the printing head and the cleaning device, is positioned along an edge of the ink-ejecting surface, and extends in the direction of crossing the ink-ejecting surface.

3. A cleaning device as claimed in claim 2, wherein the elastic wiping member and the deposit-removing member are integrally formed in one blade-shaped elastic body, and a slit is formed on the blade-shaped elastic body so that the blade-shaped elastic body is provided with a portion facing to the side of the printing head and another portion as an elastic wiping means that slides over the ink-ejecting surface of the printing head.

4. A cleaning device as claimed in claim 2, wherein the deposit-removing member is positioned in front of the side of the printing head with a predetermined distance and is able to slide over at least one part of the side of the printing head by means of its displacement as a result of a wiping operation on the ink-ejecting surface of the printing head by means of the elastic wiping member.

5. A cleaning device as claimed in claim 2, wherein the direction of the relative movement between the deposit-removing member and the printing head is different from the direction of the relative movement between the elastic wiping member and the printing head.

6. A cleaning device as claimed in claim 2, further comprising:

a cleaning blade that extends along the direction intersecting with the relative movement between the printing head and the cleaning device, wherein the elastic wiping member wipes the ink-ejecting surface of the printing head, and subsequently the cleaning blade cleans the ink-ejecting surface of the printing head.

7. A cleaning device as claimed in claim 6, wherein a degree of which the cleaning blade approaches to the ink-ejecting surface side for wiping is equal to or larger than a degree of which the elastic wiping member approaches to the ink-ejecting surface side for wiping.

8. An inkjet printing apparatus that forms an image on a printing medium using a printing head having an ink-ejecting surface where a plurality of ink-ejecting ports is formed for ejecting ink, comprising:

a deposit-removing member which is able to perform a relative movement with a side of the printing head, wherein the side of the printing head is positioned along an edge of the ink-ejecting surface and extends in the direction of crossing the ink-ejecting surface, and wherein the deposit-removing member is fixed on a cap unit that moves and displaces as the printing head moves.

9. An inkjet printing apparatus that forms an image on a printing medium using a printing head having an ink-ejecting surface where a plurality of ink-ejecting ports is formed for ejecting ink, comprising:

a deposit-removing member which is able to perform a relative movement with a side of the printing head, and an elastic wiping member for wiping the ink-ejection surface of the printing head by means of a relative movement between the elastic wiping member and the printing head, wherein the elastic wiping member is displaceable by itself against the deposit-removing member, wherein the side of the printing head is positioned along an edge of the ink-ejecting surface and extends in the direction of crossing the ink-ejecting surface.

10. An inkjet printing apparatus as claimed in claim 9, wherein the elastic wiping member and the deposit-removing member are integrally formed in one blade-shaped elastic body, and a slit is formed on the blade-shaped elastic body so that the blade-shaped elastic body is provided with a portion facing to the side of the printing head and another portion as an elastic wiping means that slides over the ink-ejecting surface of the printing head.

11. An inkjet printing apparatus as claimed in claim 9, wherein the deposit-removing member is positioned in front of the side of the printing head with a predetermined distance and is able to slide over at least one part of the side of the printing head by means of its displacement as a result of a wiping operation on the ink-ejecting surface of the printing head by means of the elastic wiping member.

12. An inkjet printing apparatus as claimed in claim 9, wherein the direction of the relative movement between the deposit-removing member and the printing head is different from the direction of the relative movement between the elastic wiping member and the printing head.

13. An inkjet printing apparatus as claimed in claim 9, further comprising:

a cleaning blade that extends along the direction intersecting with the relative movement between the printing head and the deposit-removing member, wherein the elastic wiping member wipes the ink-ejecting surface of the printing head, and subsequently the cleaning blade cleans the ink-ejecting surface of the printing head.

14. An inkjet printing apparatus as claimed in claim 13, wherein a degree of which the cleaning blade approaches to the ink-ejecting surface side for wiping is equal to or larger than a degree of which the elastic wiping member approaches to the ink-ejecting surface side for wiping.

15. A cleaning device for cleaning an inkjet printing head, having ink-ejection orifices, comprising:

a wiper for cleaning an ink-ejection orifice surface of the inkjet printing head on which ink-ejection orifices are defined; and a scraper positioned partway of a relative movement passage between the inkjet printing head and a cap capable of capping the ink-ejection orifice surface, wherein the scraper is capable of removing a deposit deposited on a side of the inkjet printing head, wherein the scraper shifts its position relative to the inkjet printing head at a location where the scraper faces at least two sides of the inkjet printing head.

16. An inkjet printing apparatus having a cleaning device for cleaning an inkjet printing head provided with ink-ejection orifices, comprising:

a cap for capping an ink-ejection orifice surface of the inkjet printing head on which the ink-ejection orifices are defined;

a wiper for cleaning the ink-ejection orifice surface; and a scraper positioned partway of a relative movement passage between the inkjet printing head and the cap, wherein the scraper is capable of removing a deposit deposited on a side of the inkjet printing head, wherein the scraper shifts its position relative to the inkjet printing head at a location where the scraper faces at least two sides of the inkjet printing head.

* * * * *

UNITED STATES PATENT AND TRADEMARK OFFICE

CERTIFICATE OF CORRECTION

PATENT NO. : 6,702,423 B2
DATED : March 9, 2004
INVENTOR(S) : Okamura et al.

It is certified that error appears in the above-identified patent and that said Letters Patent is hereby corrected as shown below:

Title page,
Item [30], Foreign Application Priority Data,
"Aug. 30, 1999 (JP) …… 10-243998" should read
-- Aug. 30, 1999 (JP) …… 11-243998 --.

Column 2,
Line 60, "an image degradation may be occurred." should read -- image degradation may occur. --.

Column 3,
Line 27, "has" should read -- have --.

Column 4,
Line 43, "deposition" should be deleted.

Column 6,
Line 42, "drawings" should read -- drawings. --.

Column 11,
Line 55, "hook." should read -- hook --.

Column 17,
Line 50, "heads" should read -- head --.

Column 23,
Line 46, "head," should read -- head; --.

UNITED STATES PATENT AND TRADEMARK OFFICE

CERTIFICATE OF CORRECTION

PATENT NO. : 6,702,423 B2
DATED : March 9, 2004
INVENTOR(S) : Okamura et al.

It is certified that error appears in the above-identified patent and that said Letters Patent is hereby corrected as shown below:

Column 24,
Line 41, "head," should read -- head; --.

Signed and Sealed this

Twenty-eighth Day of December, 2004

JON W. DUDAS
*Director of the United States Patent and Trademark Office*